US006205301B1

(12) United States Patent
Shigeta et al.

(10) Patent No.: US 6,205,301 B1
(45) Date of Patent: Mar. 20, 2001

(54) TWO-SIDED IMAGE FORMING APPARATUS

(75) Inventors: Kunio Shigeta; Yotaro Sato; Hisayoshi Nagase; Satoshi Haneda, all of Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/468,500

(22) Filed: Dec. 21, 1999

(30) Foreign Application Priority Data

Dec. 22, 1998 (JP) ..... 10-364515
Dec. 25, 1998 (JP) ..... 10-369485

(51) Int. Cl.[7] ..... G03G 15/16
(52) U.S. Cl. ..... 399/66; 399/308; 399/309
(58) Field of Search ..... 399/66, 67, 68, 399/51, 302, 306, 308, 309

(56) References Cited

U.S. PATENT DOCUMENTS 5,991,563 * 11/1999 Haneda et al. ..... 399/68
6,038,410 * 3/2000 Iriyama ..... 399/51

* cited by examiner

*Primary Examiner*—Arthur T. Grimley
*Assistant Examiner*—Hoan Tran
(74) *Attorney, Agent, or Firm*—Jordan B. Bierman; Bierman, Muserlian and Lucas

(57) ABSTRACT

A two-sided image forming apparatus includes: an image carrying member; a toner image forming device for forming a toner image on the image carrying member; a belt-shaped intermediate transfer body for conveying a transfer material, having a volume resistivity R (Ω·cm) wherein the following expression is satisfied, $10^9 \leqq R < 10^{12}$; a primary transferring device for transferring the toner image on the image carrying member onto the intermediate transfer body or a front face of the transfer material; and a secondary transferring device for transferring the toner image on the intermediate transfer body onto a rear face of the transfer material. The following expressions are satisfied, $0.2 \leqq I(1B)/V \leqq 0.7$ and $0.6 \times I(1B) \leqq I(2) \leqq 1.4 \times I(1B)$, where I(1B) (μA) represents an absolute value of a primary transfer current when the toner image on the image carrying member is transferred to the front face of the transfer material by the primary transferring device, I(2) (μA) represents an absolute value of a secondary transfer current when the toner image on the intermediate transfer body is transferred to the rear face of the transfer material by the secondary transferring device, and V (mm/sec) represents a moving velocity of the intermediate transfer body.

28 Claims, 13 Drawing Sheets

○: PRIMARY TRANSFER A
△: PRIMARY TRANSFER B (WITHOUT REAR SIDE TONER IMAGE)
×: PRIMARY TRANSFER B (WITH REAR SIDE TONER IMAGE)
◇: SECONDARY TRANSFER (WITHOUT REAR SIDE TONER IMAGE)
∗: SECONDARY TRANSFER (WITH REAR SIDE TONER IMAGE)

TWO-SIDED IMAGE FORMING APPARATUS

BACKGROUND OF THE INVENTION

This invention relates to an image forming apparatus of an electrophotographic type such as a copying machine, a printer, and a FAX machine in which a charging means, an image writing means, and a developing means are disposed around an image carrying member to form a toner image, which is transferred to a transfer material and is fixed on it, and in particular, to an image forming apparatus for two-sided printing (hereinafter referred to as "two-sided image forming apparatus for simplicity's sake) capable of forming an image on each of the both sides of a transfer material.

Heretofore, in image forming for two-sided printing (hereinafter referred to as "two-sided image forming" for simplicity's sake), it has been employed a method in which an image for one side formed on an image carrying member is transferred to a transfer material and is fixed on it and the image is once received in a duplex reversible feeding apparatus, the transfer material being again fed from the duplex reversible feeding apparatus at a proper timing for another image formed on the image carrying member, and the another image is transferred onto the other surface of the transfer material and is fixed on it.

As described in the above, in this two-sided image forming apparatus, transport of a transfer material such as feeding to the duplex reversible feeding apparatus and passing twice through a fixing apparatus must be done; therefore, reliability in transport of a transfer material is low, and it has been a cause to bring about the jamming and creasing of the transfer material.

On the other hand, it has been proposed a method in which toner images are formed on the both sides of a transfer material by using an image carrying member and an intermediate transfer member and then the images are fixed simultaneously in the publications of examined patent applications S49-37538 and S54-28740, and in the publications of unexamined patent applications H1-44457, H4-214576 and H10-133430.

Further, the inventors of this application have disclosed in publications of unexamined patent applications H9-258492 and H9-258516 an image forming apparatus and an image forming method in which a plurality of means for forming a toner image composed of a charging means, an image writing means, a developing means, etc. are disposed around a photoreceptor drum (an image carrying member), and after superposed color toner images formed on the photoreceptor drum are once transferred to a belt-shaped intermediate transfer member by a primary transfer means, another superposed color toner images are formed on the photoreceptor drum, then a transfer material which is fed at a proper timing to the toner images on the photoreceptor and the toner images on the intermediate transfer member is charged by a transfer material charging means to be attracted to the intermediate transfer member, and further, after the toner images on the photoreceptor drum are transferred as an image for the front side to the front side of a transfer material which is transported by the intermediate transfer member by using a primary transfer means and the toner images on the intermediate transfer member are transferred as an image for the rear side by a secondary transfer means, the transfer material is detached from the intermediate transfer member by the curvature at the end portion of the intermediate transfer member near a fixing apparatus (a fixing means) and the charge eliminating by a transfer material detaching means to be provided at need, and the toner images on the transfer material are fixed by a fixing means to form two-sided color images.

FIG. 9(*a*) and FIG. 9(*b*) show a two-sided image forming apparatus of the embodiment 1 to be explained in detail later which is of a type in which toner images are formed on the both sides of a transfer material by using one image carrying member and an intermediate transfer member; FIG. 9(*a*) is a drawing showing the outline structure, and FIG. 9(*b*) is a drawing illustrating the transfer process in this two-sided image forming apparatus. Further, FIG. 10(*a*) and FIG. 10(*b*) show a two-sided image forming apparatus of the embodiment 2 to be explained in detail later which is of a type in which toner images are formed on the both sides of a transfer material P by using two image carrying members 110 and 210 and an intermediate transfer member 14*a*; FIG. 10(*a*) is a drawing showing the outline structure, and FIG. 10(*b*) is a drawing illustrating the transfer process.

In an ordinary image forming apparatus, it is a general structure that a toner image on an image carrier is transferred onto a transfer material as it is when transferring onto the transfer material, and the transfer material always lies between a transferring means and the image carrier. On the contrary, in any of the above-mentioned two-sided image forming apparatuses, toner images are formed on both sides of a sheet through the total three times of transferring, including transferring in two times at the primary transferring section and transferring in one time at the secondary transferring section. In FIG. 9, any of primary transferring A and primary transferring B represents a process to transfer a toner image on a photoreceptor drum (image carrier) by charging the reverse side of an intermediate transfer member belt, but there is a possibility that transfer efficiency varies depending on whether a sheet (transfer material) exists or not. In the primary transferring B wherein a toner image lies between an intermediate transfer member and the reverse side of a sheet, it is necessary to give consideration to effect of the foregoing. Even in the publication of unexamined patent application H10-133430 stated above, effects on the primary transferring A and the primary transferring B are indicated. However, the inventors of the invention found that there is a close connection between the primary transferring and a moving speed of the intermediate transfer member.

On the other hand, secondary transferring represents a process to transfer a toner image on the intermediate transfer member onto the reverse side of a sheet by charging the obverse side of the sheet, in which a toner image on the obverse side of the sheet is given electric charges with opposite polarity. Therefore, it was found that the toner image is feared to be disturbed, and it is necessary to consider an influence of a toner image on the opposite side of the sheet in the secondary transferring.

Further, the intermediate transfer member belt takes part in all of the three times of transferring, and it was also found that there is a close connection between the moving speed of the intermediate transfer member and control of the secondary transferring, in particular.

In both of the above-described two-sided image forming apparatus, transferring is done three times, that is, twice in the primary transfer portion and once in the secondary transfer portion to form toner images on the both sides of the paper sheet P. In FIGS. 9(*a*) and 9(*b*), both of the primary transfer A and the secondary transfer B are the processes in which toner images on the photoreceptor drum 10 (an image carrying member) are transferred by charging the rear surface of the intermediate transfer belt 14*a*; however, it is possible that the performance of transfer is varied by the presence or absence of the paper sheet P (a transfer material). Further, because toner images exist between the intermediate transfer member 14*a* and the rear side of the paper sheet in the primary transfer B, it is necessary to study the influence of this. On the other hand, the secondary transfer is a process in which toner images on the intermediate transfer member 14*a* are transferred to the rear side of the paper sheet by charging the front side of the paper sheet; however, because the toner images on the front side of the paper sheet are given a charge of opposite polarity, there is a possibility that the toner images are disturbed. Further, in the secondary transfer, it is necessary to study the influence of the toner images on the opposite side of the paper sheet. Furthermore, because the intermediate transfer member 14*a* is involved in all of these three transfer processes, it is necessary to study the influence of it.

In a two-sided image forming apparatus for forming an image on each of both sides of a transfer material by using a belt-shaped intermediate transfer member as described in the above, the toner images on the front and rear sides of the transfer material are fixed by using a fixing means composed of a pair of fixing members (a pair of fixing rollers); however, if the electric resistance of the fixing members are low, or if either or both of the fixing members are grounded, it is brought about a problem that electric charge leaks from the transfer material through the fixing means to cause the transfer of the toner images to the rear side of the transfer material not to be carried out satisfactorily.

Namely, in the conventional fixing means, what is considered is only fixing on one side of a transfer material, and even in the case of a conventional two-sided image forming apparatus, the fixing process is divided into two steps for the obverse side and the reverse side. On the other hand, in the image forming apparatus like the present invention, unfixed toner images are formed on both sides of a transfer material to be fed into a fixing means, which is quite different from the conventional image forming apparatus wherein unfixed toner images are formed only on one side of a transfer material. This causes the above-mentioned problems.

Further, it is also brought about a problem that, when the transfer material enters between the fixing members, the electric image charge of the toner particles on the transfer material is induced on the fixing members, which disturbs the toner images on the front and rear sides of the transfer material to cause a satisfactory two-sided image formation not to be performed.

Further, also in the case where the fixing members are formed of an insulating material, it is brought about a problem that electric charge is accumulated on the fixing members, and the toner images on the front and rear sides of a transfer material are disturbed by the accumulated charge to cause a satisfactory two-sided image formation not to be performed.

It is an object of this invention to propose an electrical characteristic of the intermediate transfer member required for obtaining a satisfactory images for two-sided printing (hereinafter referred to as "two-sided images" for simplicity's sake) and a transfer condition for carrying out the primary transfer and the secondary transfer in the above-mentioned two-sided image forming apparatus.

It is another object of this invention solving the above-described problems to provide an image forming apparatus capable of forming satisfactory two-sided images by preventing the leakage of electric charge from a transfer material to perform transfer of the toner images to the rear side of the transfer material satisfactorily and by preventing the disturbance of the toner images on the front and rear sides by the fixing means.

The above-mentioned objects are accomplished by any one of the following structures.

Structure (1): A two-sided image forming apparatus comprising:

(a) an image carrying member;

(b) a toner image forming means for forming a toner image on the image carrying member;

(c) a belt-shaped intermediate transfer body for conveying a transfer material, having a volume resistivity R (Ω·cm) wherein the following expression is satisfied, $$10^9 \leqq R < 10^{12};$$

(d) a primary transferring means for transferring the toner image on the image carrying member onto the intermediate transfer body or a front face of the transfer material; and (e) a secondary transferring means for transferring the toner image on the intermediate transfer body onto a rear face of the transfer material,
wherein the following expressions are satisfied, $$0.2 \leqq I(1B)/V \leqq 0.7$$

and $$0.6 \times I(1B) \leqq I(2) \leqq 1.4 \times I(1B)$$

where I(1B) (μA) represents an absolute value of a primary transfer current when the toner image on the image carrying member is transferred to the front face of the transfer material by the primary transferring means, I(2) (μA) represents an absolute value of a secondary transfer current when the toner image on the intermediate transfer body is transferred to the rear face of the transfer material by the secondary transferring means, and V (mm/sec) represents a moving velocity of the intermediate transfer body.

Structure (2): A two-sided image forming apparatus comprising:

(a) an image carrying member;

(b) a toner image forming means for forming a toner image on the image carrying member;

(c) a belt-shaped intermediate transfer body for conveying a transfer material, having a volume resistivity R (Ω·cm) wherein the following expression is satisfied, $$10^9 \leqq R < 10^{12};$$

(d) a primary transferring means for transferring the toner image on the image carrying member onto the intermediate transfer body or a front face of the transfer material; and (e) a secondary transferring means for transferring the toner image on the intermediate transfer body onto a rear face of the transfer material,
wherein the following expression is satisfied, $$0.12 \leqq I(2)/V \leqq 0.98$$

where I(2) (μA) represents an absolute value of a secondary transfer current when the toner image on the intermediate transfer body is transferred to the second face of the transfer material by the secondary transferring means, and V (mm/sec) represents a moving velocity of the intermediate transfer body.

Structure (3): A two-sided image forming apparatus comprising:

(a) a first image carrying member;

(b) a first image forming means for forming a toner image on the first image carrying means;

(c) a second image carrying member;

(d) a second image forming means for forming a toner image on the second image carrying means;

(e) a belt-shaped intermediate transfer body for conveying a transfer material, having a volume resistivity R (Ω·cm) wherein the following expression is satisfied, $$10^9 \leqq R < 10^{12};$$

(f) a first primary transferring means for transferring the toner image on the first image carrying member onto the intermediate transfer body;

(g) a second primary transferring means for transferring the toner image on the second image carrying member onto a front face of the transfer material; and (h) a secondary transferring means for the toner image on the intermediate transfer body onto a rear face of the transfer material, wherein the following expressions are satisfied, $$0.2 \leqq I_2(1B)/V \leqq 0.7$$

and $$0.6 \times I_2(1B) \leqq I(2) \leqq 1.4 \times I_2(1B)$$

where $I_2(1B)$ (μA) represents an absolute value of a second primary transfer current when the toner image on the second image carrying member is transferred to the front face of the transfer material by the second primary transferring means, I(2) (μA) represents an absolute value of a secondary transfer current when the toner image on the intermediate transfer body is transferred to the rear face of the transfer material by the secondary transferring means, and V (mm/sec) represents a moving velocity of the intermediate transfer body.

Structure (4): A two-sided image forming apparatus comprising:

(a) a first image carrying member;

(b) a first toner image forming means for forming a toner image on the first image carrying member;

(c) a second image carrying member;

(d) a second toner image forming means for forming a toner image on the second image carrying means;

(e) a belt-shaped intermediate transfer body for conveying a transfer material, having a volume resistivity R (Ω·cm) wherein the following expression is satisfied, $$10^9 \leqq R < 10^{12};$$

(f) a first primary transferring means for transferring the toner image on the first image carrying member onto the intermediate transfer body;

(g) a second primary transferring means for transferring the toner image on the second image carrying member onto a front face of the transfer material; and (h) a secondary transferring means for transferring the toner image on the intermediate transfer body onto a rear face of the transfer material, wherein the following expression is satisfied, $$0.12 \leqq I(2)/V \leqq 0.98$$

where I(2) (μA) represents an absolute value of a secondary transfer current when the toner image on the intermediate transfer body is transferred to the rear face of the transfer material by the secondary transferring means, and V (mm/sec) represents a moving velocity of the intermediate transfer body.

Structure (5): A two-sided image forming apparatus comprising:

(a) an image carrying member;

(b) a toner image forming means for forming a toner image on the image carrying member;

(c) a belt-shaped intermediate transfer body for conveying a transfer material;

(d) a primary transferring means for transferring the toner image on the image carrying member onto the intermediate transfer body or a front face of the transfer material;

(e) a secondary transferring means for the toner image on the intermediate transfer body onto a rear face of the transfer material; and (f) a fixing means for interposing the transfer material to convey and for fixing the toner image transferred on both faces of the transfer material, the fixing means comprising a pair of rotatable fixing members, wherein an electric voltage of the same polarity as the transfer material on the both faces of which the toner images are transferred is applied to the fixing member to be in contact with the front face of the transfer material.

DETAILED DESCRIPTION OF THE PREFERRED EMBODIMENT

Before explaining the embodiment of this invention, the explanation of this invention will be given.

Figure 1:
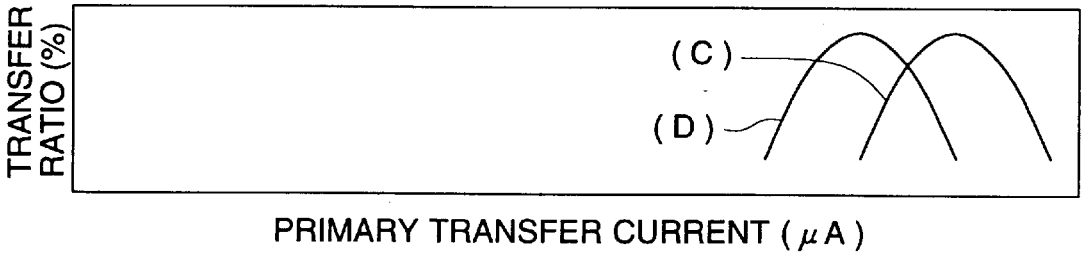
FIG. 1(*a*) to FIG. 1(*c*) are drawings showing the transfer characteristics of intermediate transfer members.
Figure 1:
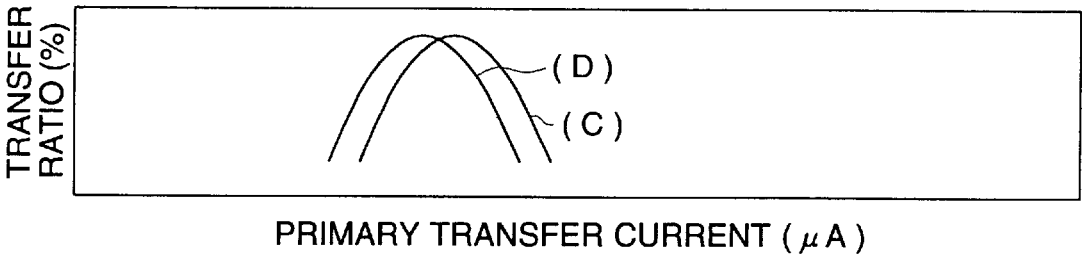
Figure 1:
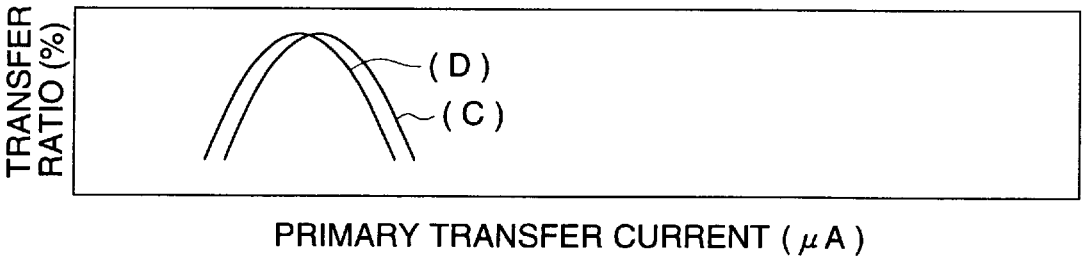
Figure 9:
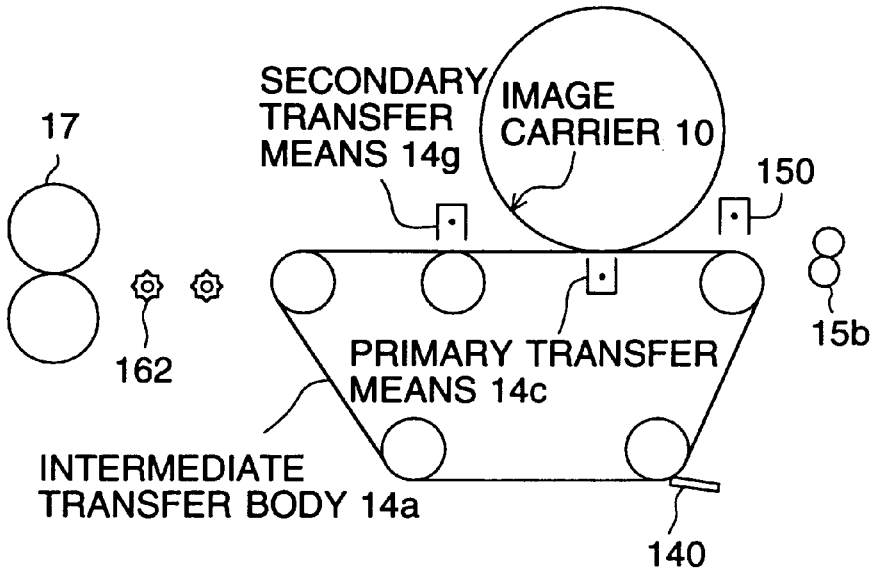
FIG. 9(*a*) and FIG. 9(*b*) are drawings showing the outline of the structure of a two-sided image forming apparatus and illustrating the transfer process respectively.
Figure 9:
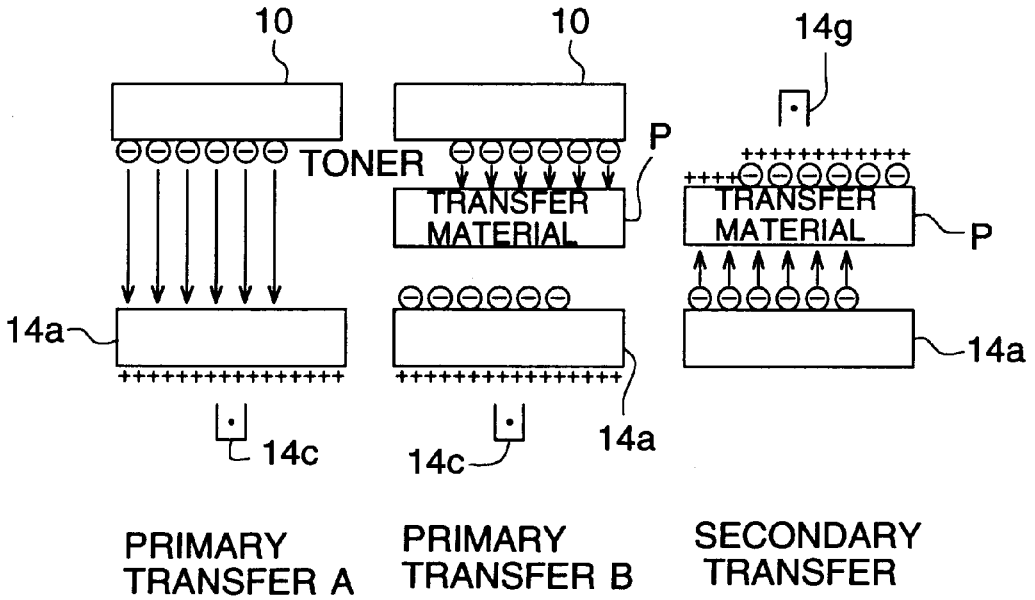
Figure 10:
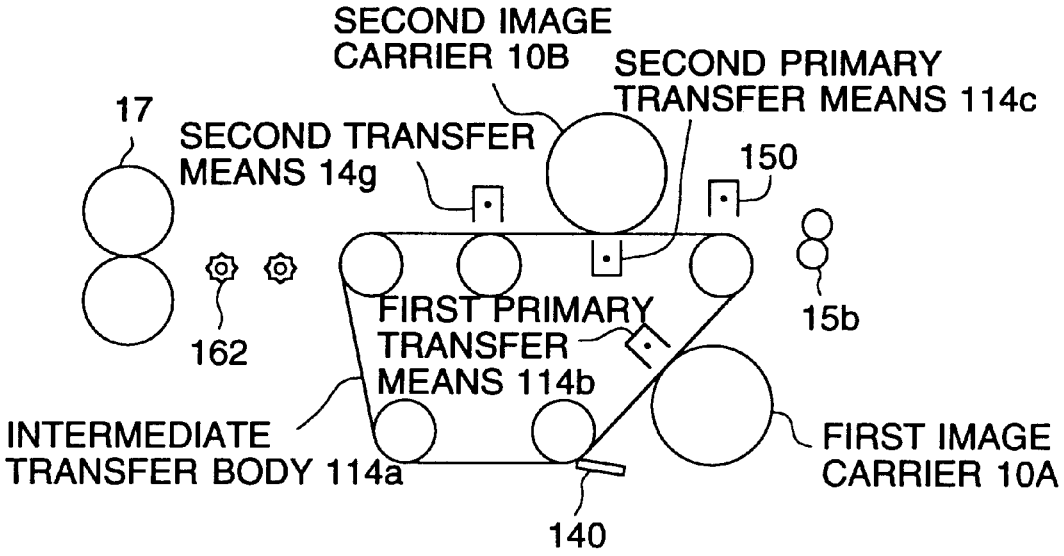
FIG. 10(*a*) and FIG. 10(*b*) are drawings showing the outline of the structure of another two-sided image forming apparatus and illustrating the transfer processes respectively.
Figure 10:
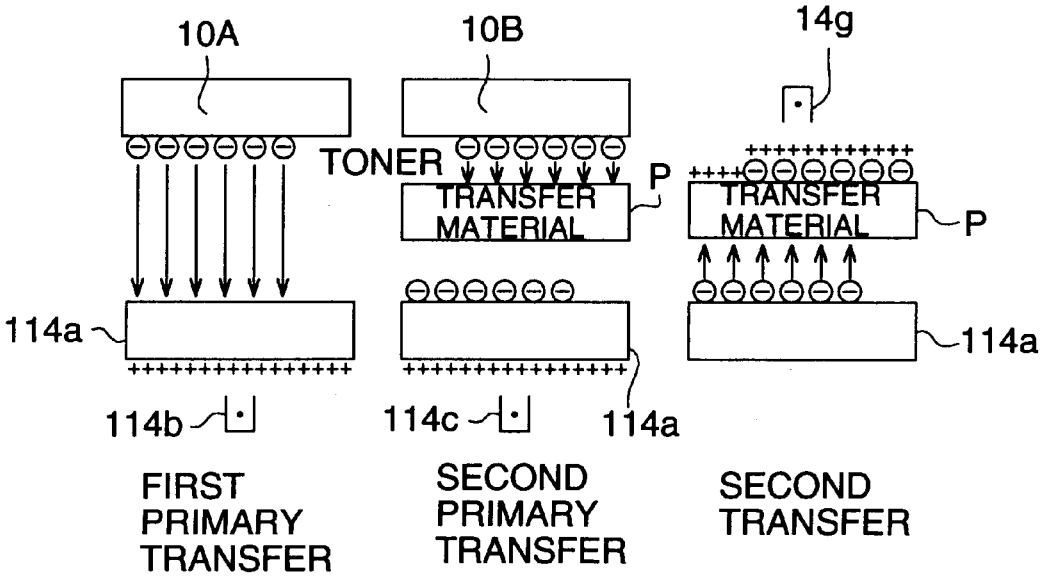

With respect to a two-sided image forming apparatus shown in FIGS. 9(*a*) and 9(*b*) or in FIGS. 10(*a*) and 10(*b*), the transfer conditions for the primary transfer B or the second primary transfer, using intermediate transfer belts of a low resistance, a medium resistance, and a high resistance shown in FIGS. 1(*a*), 1(*b*), and 1(*c*) respectively, when a front side image formed on the image carrying member is transferred to a transfer material with a transfer bias voltage applied from the back side of the intermediate transfer belt, in the cases where toner deposition corresponding to the rear side image is present on the intermediate transfer belt (C) and no rear side image is present on the intermediate transfer belt (D), are shown in FIG. 1(*a*) to FIG. 1(*c*).

What is clearly understood from the graphs in FIGS. 1(*a*) to 1(*c*) showing the dependence of the transfer efficiency on the transfer current is as follows:

(1) In the case FIG. 1(*a*) where the intermediate transfer member has a low resistance, a higher optimum primary transfer current is required in comparison with the case FIG. 1(*c*) where the intermediate transfer member has a high resistance. This phenomenon is interpreted as follows: in the low-resistance case, the optimum transfer current is increased with the increasing of the leakage current.

(2) In the case where the intermediate transfer member has a low resistance, a large difference in the optimum transfer current value can be recognized between the cases where a rear side image (a toner image) is present (C) and absent (D) on the intermediate transfer member in comparison with the case where the intermediate transfer member has a high resistance.

Figure 2:
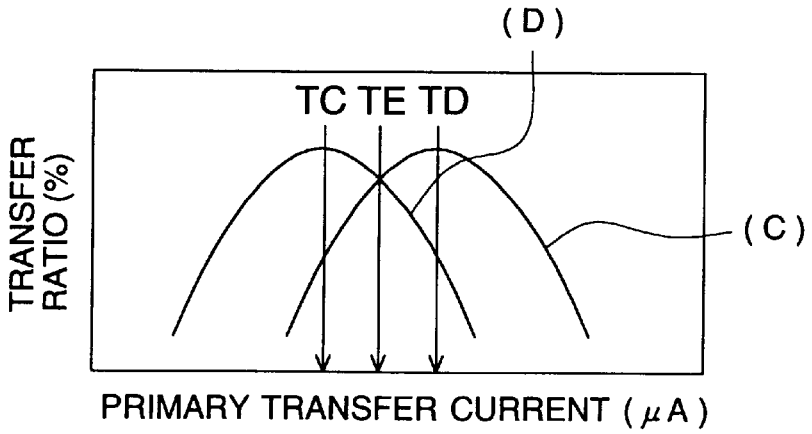
FIG. 2(*a*) and FIG. 2(*b*) are drawings illustrating the primary transfer B characteristics of an intermediate transfer member having a high electric resistance.
Figure 2:
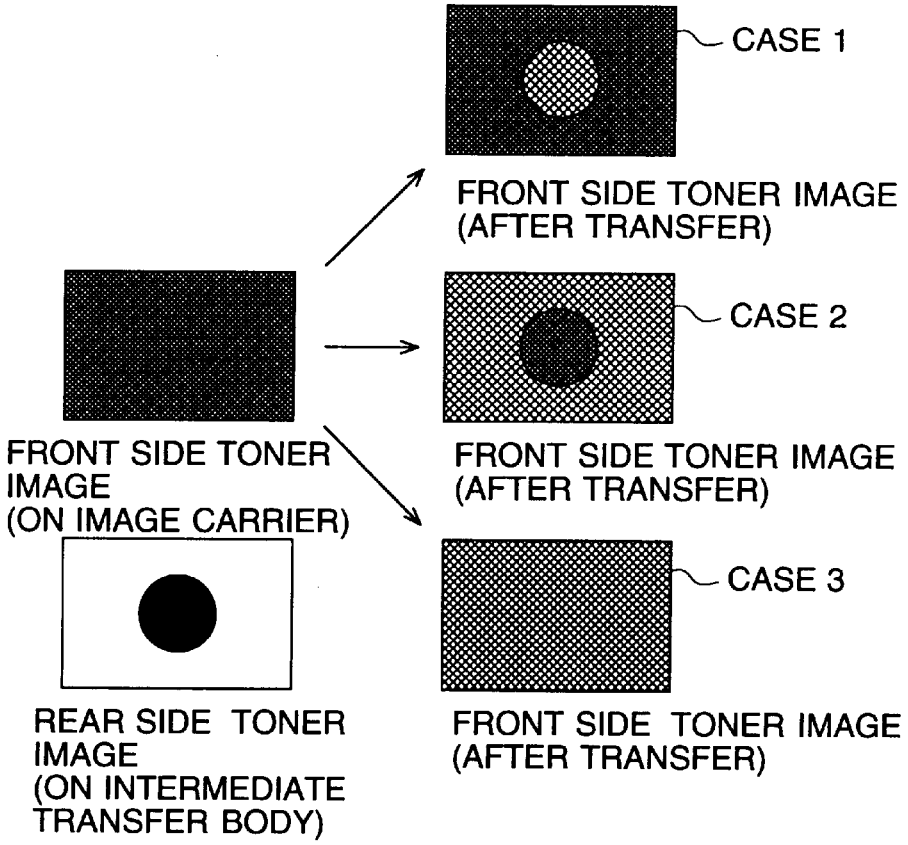

Particularly remarking (2), it is shown in FIGS. 2(*a*) and 2(*b*) the result of a study on the primary transfer B or the second primary transfer in the case where a low-resistance intermediate transfer member is used. As shown in FIG. 2(*a*), in the case where a low-resistance intermediate transfer member is used, the curves of transfer efficiency are deviated from each other for the cases where a rear side image is present (C) or not present (D) on the intermediate transfer member, owing to a large influence of the presence or absence of the toner image having electric charge of the opposite polarity to the transfer bias voltage on the intermediate transfer member. Accordingly, it is posed a problem that a negative or positive ghost image of the rear side image appears in the front side image or the transfer efficiency of the front side image becomes low to cause the density of the image to be lowered.

FIG. 2(*b*) is a drawing showing this situation; in the case (case 1) where the primary transfer current is set at TC, a negative ghost of the rear side image appears because the transfer efficiency in the area where no rear side image is present is higher than that in the area where a rear side image is present. Further, in the case (case 2) where the primary transfer current is set at TD, a positive ghost of the rear side image appears because the transfer efficiency in the area where a rear side image is present is higher than that in the area where no rear side image is present. Moreover, in the case (case 3) where the primary transfer current is set at TE between TC and TD, no ghost appears because the transfer efficiency is the same for both areas where a rear side image is present and not present. However, because the transfer efficiency itself becomes lower than the peak value, the image density of the front side is lowered. That is, a low-resistance intermediate transfer member is not suitable for the intermediate transfer member for use in a two-sided image forming apparatus of this invention, and according to the result of an experimental study, it is required that $$10^9 \leq R,$$

where R (Ω·cm) is the volume resistivity of the intermediate transfer member.

Figure 3:
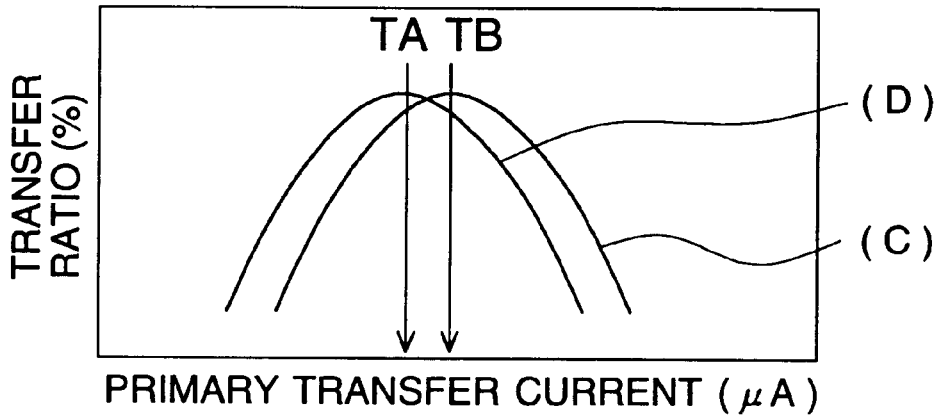
FIG. 3(*a*) and FIG. 3(*b*) are drawings illustrating the primary transfer B characteristics of an intermediate transfer member having a medium electric resistance.
Figure 3:
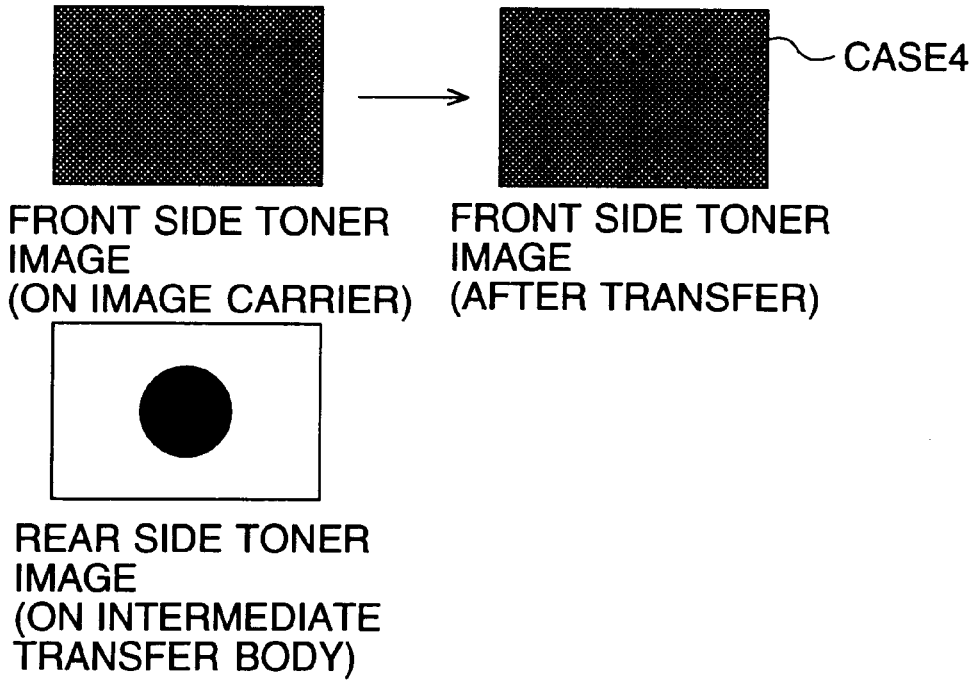

FIGS. 3(*a*) and 3(*b*) are drawings showing the transfer characteristics of the primary transfer B or the second primary transfer in the case where a medium-resistance intermediate transfer member is used; as shown in FIG. 3(*a*), in the case where a medium-resistance intermediate transfer member is used, the curves of the transfer efficiency are not so much deviated for the cases where a rear side image is present and not present owing to a small influence of the presence or absence of the toner image on the intermediate transfer member. Accordingly, transferring becomes possible under a condition that the image density is kept high and no ghost appears. For the condition to be determined in this case, the current value between TA and TB in the drawing is suitable (case 4).

Further, in the case where a high-resistance intermediate transfer member is used, the two curves for the cases where a rear side image is present and not present on the intermediate transfer member come close to each other, and transfer itself becomes satisfactory; however, after the transfer to the intermediate transfer member or after the transfer to the front side of a transfer paper sheet, detachment discharging occurs at the time when the intermediate transfer member or the transfer paper sheet is detached from the photoreceptor to disturb the toner image on the intermediate transfer member or on the front side of the transfer paper sheet. In some other cases, discharging occurs also at the time when the back surface of the intermediate transfer member comes close to a grounded roller after the transfer to the intermediate transfer member to disturb the toner image on the intermediate transfer member. Further, also at the time when the transfer paper sheet is detached from the intermediate transfer member, detachment discharging occurs to cause the toner image on the front side or on the rear side of the transfer paper sheet to be disturbed.

That is, for the intermediate transfer member for use in a two-sided image forming apparatus of this invention, a high-resistance intermediate transfer member is not suitable, and according to the result of an experimental study, it is required that the volume resistivity of the intermediate transfer member R (Ω·cm) in the high resistance region satisfies the following inequality $$R < 10^{12},$$

and by considering the aforementioned result of the study in the low resistance region, it is required that R satisfies the following inequality:

$$10^9 \leqq R < 10^{12} \quad (1)$$

Besides, the above-described study of transfer is carried out for the amount of used toner charge of 10 to 30 $\mu$C/g in the absolute value and for the case where the amount of toner deposition on the image carrying member before transfer is 0.5 to 1.0 mg/cm$^2$.

It is suitable to determine the transfer current value to be a value between TA and TB in FIG. 3(*a*) as the transfer condition of the primary transfer B (or the second primary transfer) in the case where the toner image on the image carrying member is transferred to the front side of a transfer material by the primary transfer means acting from the back side of the transfer material and the intermediate transfer member (case 4), and if the transfer current value falls out of the proper range positioned between TA and TB, not only the transfer efficiency is made low, but also a negative or positive ghost appears.

The result of an experimental study which is carried out with the combination of various kinds of intermediate transfer member satisfying the inequality condition (1), a thick or thin paper sheet for the transfer material to be used, environmental condition, etc., shows that I(1B) ($\mu$A) (or $I_2$(1B) ($\mu$A)), which is let to be the absolute value of the suitable transfer current for the primary transfer B (or the second primary transfer), should satisfy the following inequality:

$$0.2 \leqq I(1B)/V \leqq 0.7 \quad (2),$$

or $$0.2 \leqq I_2(1B)/V \leqq 0.7, \quad (2'),$$

where V (mm/sec) is let to be the moving velocity of the intermediate transfer member, and if the transfer current falls out of the range of the above-described condition, the transfer efficiency becomes low and the occurrence of a negative or positive ghost of the rear side image is recognized.

Further, in the case where a medium-resistance intermediate transfer member satisfying the inequality condition (1) is used and the toner image on the image carrying member is transferred to the intermediate transfer member by the primary transfer means acting from the back side of the intermediate transfer member, I(1A) ($\mu$A) (or I(11) ($\mu$A)), which is let to be the absolute value of the transfer current for the primary transfer A (or the first primary transfer), should satisfy the following inequality:

$$0.4 \times I(1B) \leqq I(1A) \leqq 0.8 \times I(1B) \quad (3),$$

or $$0.4 \times I_2(1B) \leqq I_1(1A) \leqq 0.8 \times I_2(1B) \quad (3'),$$

and if the transfer current falls out of the range of the above-described condition, the transfer efficiency becomes low and the current value is not suitable for use.

As is evident from the inequality conditions (2) and (3), the proper transfer current value for the primary transfer A, which denotes transfer from the image carrying member to the intermediate transfer member, is considerably lower than the proper transfer current value for the primary transfer B, which denotes transfer from the image carrying member to a transfer material. In the case of the primary transfer B, it can be deduced that the amount of electric charge required for the transfer becomes larger in comparison with the primary transfer A, owing to the presence of a transfer material between the image carrying member and the intermediate transfer member and owing to it that the paper electric charge of the same polarity as the toner is given to the surface of the transfer material as will be described later. With this point taken into consideration, it is necessary to change over the transfer current value between the primary transfer A and the primary transfer B.

The secondary transfer is a process in which the toner image on the intermediate transfer material is transferred to the rear side of a transfer material by charging the front side of the transfer material; however, it is possible that the toner image is disturbed owing to it that the electric charge of the opposite polarity is given to the toner image on the front side of the transfer material. Further, it may be felt necessary to study the influence of the toner image on the opposite side of the transfer material in the secondary transfer too. However, according to the result of a study, the influence of the toner image on the reverse side of the transfer material has been proved to be small as in the case of the primary transfer B, to make it of no problem.

Let I(2) ($\mu$A) be the absolute value of the secondary transfer current at the time when the toner image on the intermediate transfer member to the rear side of a transfer material by the secondary transfer means, then it should satisfy the following inequalities:

$$0.6 \times I(1B) \leqq I(2) \leqq 1.4 \times I(1B) \quad (4),$$

and $$0.6 \times I_2(1B) \leqq I(2) \leqq 1.4 \times I_2(1B) \quad (4'),$$

and if it falls out of the range of the above-described inequality conditions, the transfer efficiency becomes low and sometimes the toner image on the front side of the transfer material is disturbed, and it is not suitable for use.

Incidentally, the relationship between secondary transferring current and the moving speed of the intermediate transfer member is shown as follows, $$0.12 \leqq I(2)/V \leqq 0.98$$

and this is obtained from the expressions (2) and (4) described above, and shows that there is a close connection between the secondary transferring current and the moving speed of the intermediate transfer member.

Figure 4:
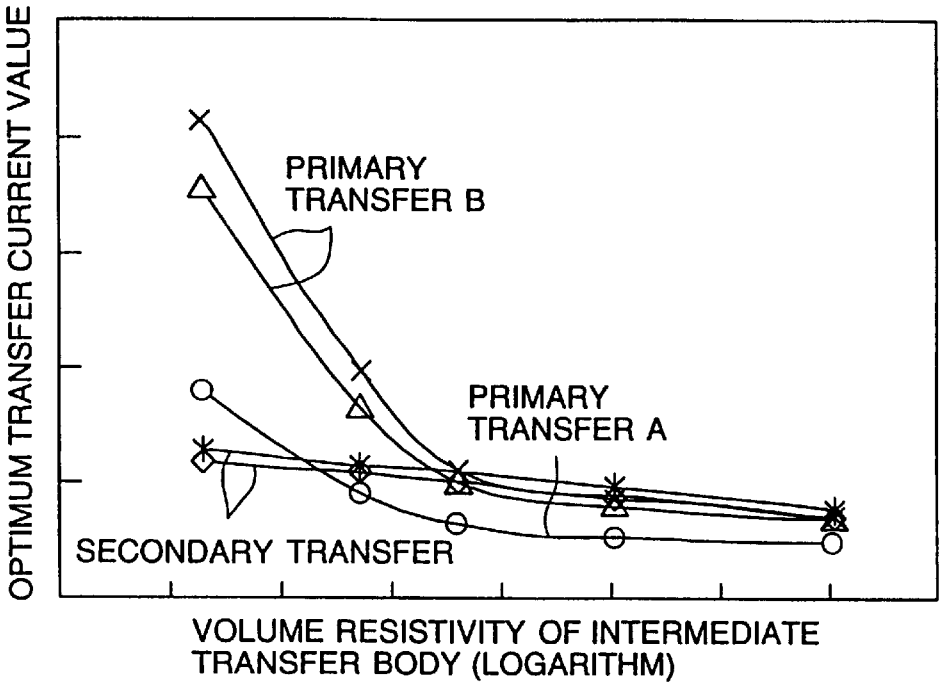
FIG. 4 is a graph showing the relationships between the electric resistance of an intermediate transfer material and the optimum transfer current.

FIG. 4 is a graph showing the relationships between the volume resistivity of the intermediate transfer member and the optimum transfer current value in the primary transfer B, the primary transfer A, and the secondary transfer respectively; it indicates that I(1B), I(1A), and I(2) all fall within the range of the inequality conditions (2) to (4) respectively, as long as the toner image is transferred with a medium-resistance intermediate transfer member within the range of the inequality condition (1) used.

In the following, the embodiments of this invention will be explained. In addition, the description herein should not limit the technical scope of the claims and the meaning of terms used. Further, the affirmative explanation in the embodiments of this invention indicates the best mode and should not limit the meaning of the terms used in this invention and the technical scope. Besides, in the explanation of the embodiments to be made below, the front side denotes the side of a transfer material facing the image carrying member at the transfer portion, and the rear side denotes the other side of the transfer material, that is, the side facing the intermediate transfer member; the front side image denotes the image (to be) transferred to the front side of a transfer material, and the rear side image denotes the image (to be) transferred to the rear side of a transfer material.

Embodiment 1

Figure 5:
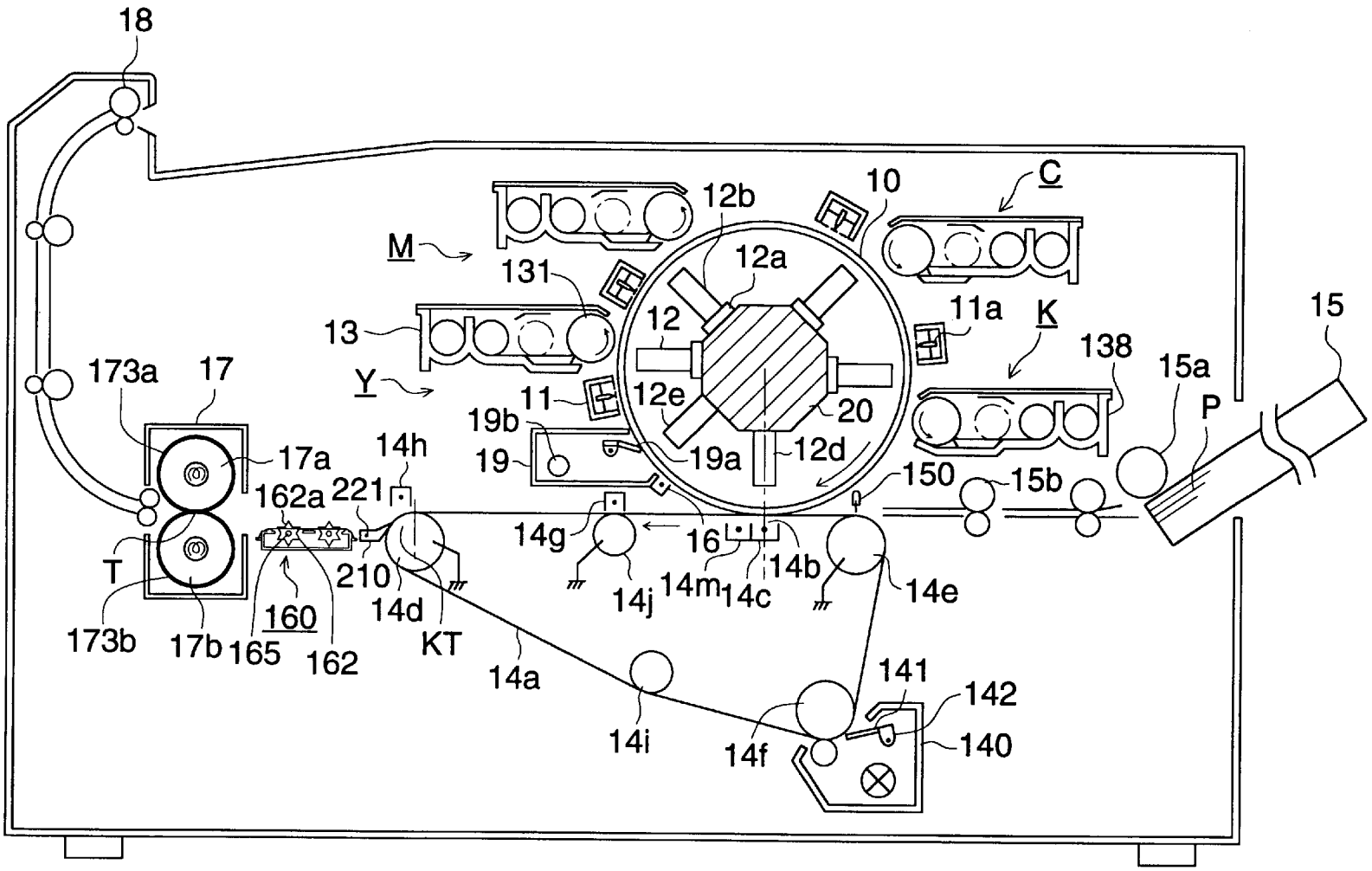
FIG. 5 is a cross-sectional view of the structure of a two-sided image forming apparatus of the embodiment 1.
Figure 6:
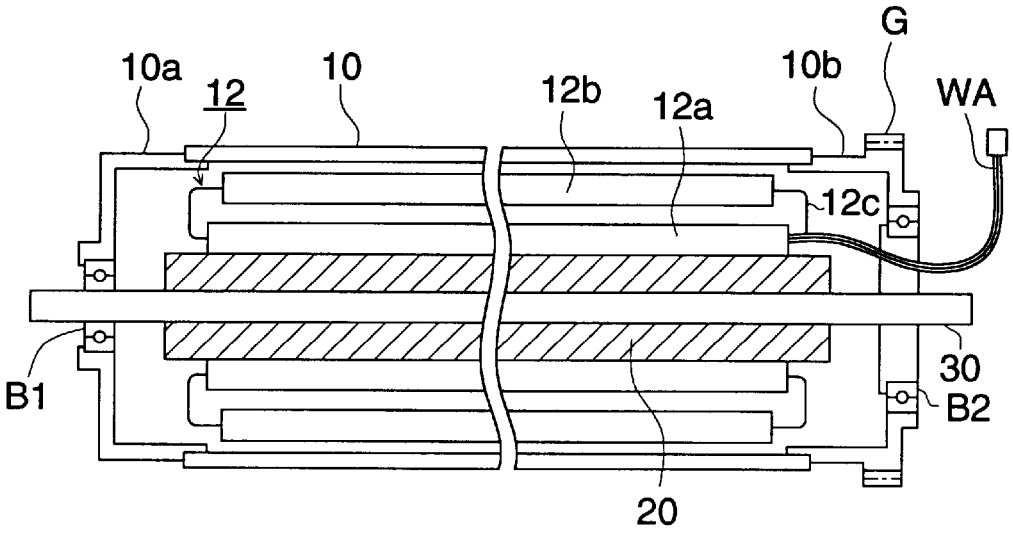
FIG. 6 is a side cross-sectional view of an image carrying member shown in FIG. 5.
Figure 7:
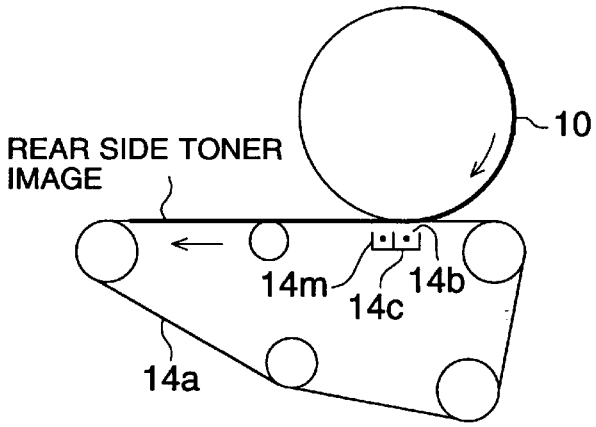
FIG. 7(*a*) to FIG. 7(*c*) are drawings showing how toner images are formed in the embodiment 1.
Figure 7:
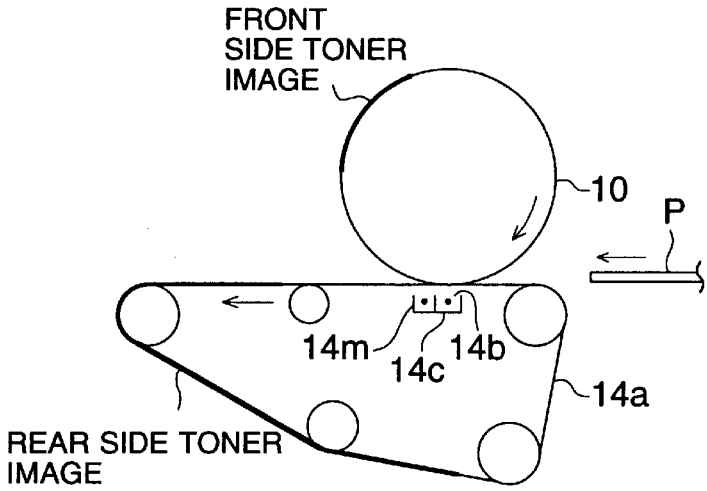
Figure 7:
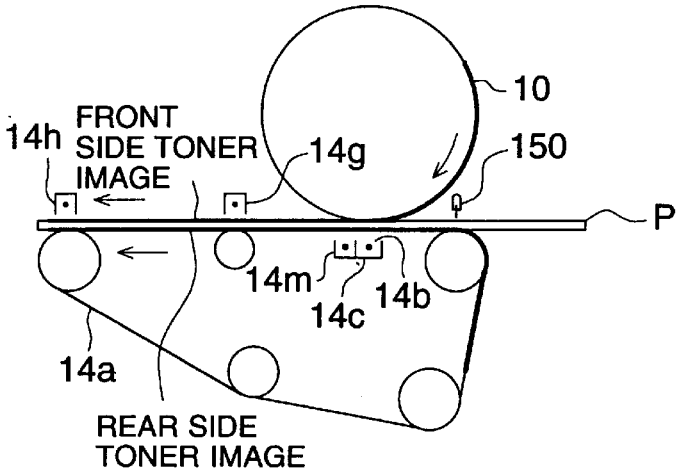

The image forming process and each of the mechanisms in an example of the embodiment of a two-sided image forming apparatus of this invention will be explained with reference to FIG. 5 to FIG. 7(*c*). FIG. 5 is a cross-sectional view of the structure of a color image forming apparatus indicating an example of the embodiment of a two-sided image forming apparatus of this invention, FIG. 6 is a side cross-sectional view of the image carrying member shown in FIG. 5, and FIG. 7(*a*) to FIG. 7(*c*) are drawings showing how toner images are formed in a two-sided image forming apparatus of this invention; FIG. 7(*a*) is a drawing showing how a toner image is formed when a rear side image formed on the image carrying member is transferred to the intermediate transfer member, FIG. 7(*b*) is a drawing showing how a toner image is formed when a front side image is formed in synchronism with the rear side image on the intermediate transfer member, and FIG. 7(*c*) is a drawing showing two-sided image formation on a transfer material.

In FIG. 5, 10 is the photoreceptor drum which denotes an image carrying member, 11 are the scorotron chargers which denote charging means for the respective colors, 12 is the exposure optical systems which denote image writing means for the respective colors, 13 are the developing units which denote developing means for the respective colors, 14*a* is the intermediate transfer belt which denotes an intermediate transfer member, 14*c* is the primary transfer unit which denotes a primary transfer means, 14*g* is the secondary transfer unit which denotes a secondary transfer means, 150 is the paper charging unit which denotes a transfer material charging means, 14*h* is the AC charge eliminating unit for detaching a paper sheet which denotes a detaching means for a transfer material, 160 is the transporting portion comprising the pick off finger 210 which denotes a finger member and the spur 162 which denotes a spur member, and 17 is the fixing apparatus which denotes a fixing means.

The photoreceptor drum 10, which denotes an image carrying member, for example, has a transparent conductive layer and a photosensitive layer such as an amorphous silicon layer or an organic photosensitive layer (OPC) formed on the periphery of a cylindrical substrate which is formed of a transparent member such as an optical glass or a transparent acrylic resin, and is rotated in the clockwise direction shown by the arrow mark in FIG. 5 with the conductive layer grounded, at a linear velocity of 280 mm/sec in this embodiment.

As shown in FIG. 6, the photoreceptor drum 10 is supported in a manner capable of rotation by the bearings B1 and B2, which are held between the flange members 10*a* and 10*b* at the both end portions engaging with and fixing the drum, being borne at the journal portions of the drum shaft 30 which is mounted and fixed to the apparatus mainframe, and is rotated in the predetermined direction at a constant speed by being driven with the driving gear, not shown in the drawing, engaged with the gear G which is integrally formed with the flange member 10*b*.

The toner image forming means is composed of the scorotron charger 11, which denotes a charging means, the exposure optical system 12, which denotes an image writing means, and the developing unit 13, which denotes a developing means, and these makes up a set; four sets of these are provided for use in the image forming processes for the respective colors, namely, yellow (Y), magenta (M), cyan (C), and black (K), and are arranged in the order Y, M, C, and K with respect to the direction of rotation of the photoreceptor drum 10 as shown by the arrow mark in FIG. 5.

Each of the scorotron chargers 11, which denote charging means for the respective colors, comprises a control grid which is held at a predetermined electric potential and the discharging electrode 11*a* which is made up of a sawtooth electrode for example, and is mounted opposite to the photosensitive layer of the photoreceptor drum 10; it carries out charging action (negative charging in this embodiment) through corona discharging of the same polarity as the toner, giving a uniform electric potential to the photoreceptor drum 10. As for the discharging electrode 11*a*, in addition to the above, it is possible to employ a wire electrode or a needle-shaped electrode.

The exposure optical systems 12, which denote image writing means for the respective colors, are disposed inside the photoreceptor drum 10 in a manner such that the exposure positions on the photoreceptor drum 10 come to the downstream sides with respect to the rotating direction of the photoreceptor drum 10 against the above-described scorotron chargers 11 for the respective colors. As shown in FIG. 6, each of the exposure optical systems 12 is a unit for exposure composed of the linear exposure element 12*a* which has a plurality of LED's (light emitting diodes) as light emitting elements for an image exposure light (an image writing light) arrayed parallel to the drum shaft 30 in the main scanning direction, the convergent light transmitting member (commercial name: SELFOC lens array) 12*b* as an image forming element, and the lens holder 12*c*, and is mounted to the holding member 20. In addition to the exposure systems 12 for the respective colors, the co-transfer exposure unit 12*d* and the uniform exposure unit 12*e* are mounted to the holding member 20 to make an integral part, which is received inside the transparent substrate of the photoreceptor drum 10. The exposure systems 12 for the respective colors perform image writing to the photosensitive layer from the rear side in accordance with the image data for the respective colors which are read by a separately provided image reading apparatus and memorized in a memory to form a latent electrostatic image on the photoreceptor drum 10. As for the exposure element 12*a*, in addition to the LED's, it is possible to use also one having a plurality of light emitting elements such as FL's (fluorescent luminescence elements), EL's (electroluminescence elements), PL's (plasma luminescence elements), etc. arranged in an array. In respect of the wavelength of the light emitting elements for the image exposure light (image writing light), one in the range of 780 nm to 900 nm, which has a high transmittance to the toners for Y, M, and C, is usually used; however, this embodiment employs a method in which image writing is carried out from the rear side, therefore, the wavelength in the range of 400 nm to 780 nm, which is shorter than the above-described one and has not enough transmittance to the color toners, can be used. Further, because more than 80% of the image exposure light is absorbed by the photosensitive layer of the photoreceptor drum 10, the influence of reflection and absorption by the color toner particles on the surface of the photoreceptor drum 10 can be neglected. Generally speaking, the order of development by the color toners should desirably be as Y, M, C, and K in consideration of color mixing to the toner image and to the developing units 13. Incidentally, in FIG. 6, WA denotes a lead wire from the light emitting elements (LED's) for the image exposure light.

Each of the developing units 13, which denote developing means for the respective colors, comprises the developing sleeve 131 which keeps a predetermined clearance to the peripheral surface of the photoreceptor drum 10, rotate in the following direction to the rotation of the photoreceptor drum 10, and is formed of a cylindrical material of stainless steel or aluminum having, for example, a thickness of 0.5 mm to 1.0 mm and a outer diameter of 15 mm to 25 mm respectively and the developing casing 138; inside the developing casings 138, single component or two component developers of yellow (Y), magenta (M), cyan (C), and black (K) are received respectively. Each of the developing units 13 is kept in a non-contact state with a predetermined clearance, for example, 100 $\mu$m to 500 $\mu$m to the photoreceptor drum by a rolling spacer bar not shown in the drawing, and carries out non-contact reverse development to form a toner image on the photoreceptor drum 10, by the application of a developing bias voltage composed of a direct current voltage and an alternate current voltage superposed to the developing sleeve 131.

The intermediate transfer belt 14*a*, which denotes an intermediate transfer member, is an endless belt having a volume resistivity R ($\Omega$·cm) equal to or higher than $10^9$ $\Omega$·cm to lower than $10^{12}$ $\Omega$·cm, and is desirably an endless belt having a volume resistivity equal to or higher than $10^{10}$ $\Omega$·cm to lower than $10^{11}$ $\Omega$·cm; in this embodiment, it is an endless belt having a volume resistivity of $10^{10}$ $\Omega$·cm and is a seamless belt made up of two layers which are a semiconductive film base having a thickness of 0.1 mm to 1.0 mm made of an engineering plastic material, for example, a modified polyimide, a thermosetting polyimide, ethylenetetrafluoro-ethylene copolymer, a polyvinylidene fluoride, a nylon alloy, etc. with a conductive material dispersed in it and a desirable fluorine-coated layer having a thickness of 5 $\mu$m to 50 $\mu$m as a toner filming preventing layer formed on the outside of the semiconductive film. For the base of the intermediate transfer belt 14*a*, in addition to the above, a semiconductive rubber belt having a thickness of 0.5 mm to 2.0 mm made of a silicone rubber, an urethane rubber, or the like with a conductive material dispersed in it can also be used. The intermediate transfer belt 14*a* is entrained around the driving roller 14*d*, the grounded roller 14*j*, the driven roller 14*e*, the guide roller 14*f*, and the tension roller 14*i*, which are all roller members, and is revolved in the counter-clockwise direction shown by the arrow mark in FIG. 5. The guide roller 14*f*, the driven roller 14*e*, the grounded roller 14*j*, and the driving roller 14*d* are rotated at a fixed position, and the tension roller 14*j* is rotated being supported in a manner capable of moving by the resilient force of a spring etc. not shown in the drawing. The driving roller 14*d* is rotated by receiving a driving force from the driving motor not shown in the drawing to drive to revolve the intermediate transfer belt 14*a*. By the revolution of the intermediate transfer belt 14*a*, the grounded roller 14*j*, the driven roller 14*e*, the guide roller 14*f*, and the tension roller 14*i* is driven to rotate. The looseness of the intermediate transfer belt during revolution is strained by the tension roller 14*i*. The recording paper sheet P, which denotes a transfer material, is fed to the position where the intermediate transfer belt 14*a* is entrained on the driven roller 14*d*, and is transported by the intermediate transfer belt 14*a*. The recording paper sheet P is detached from the intermediate transfer belt 14*a* at the curvature portion KT at the end portion of the intermediate transfer belt 14*a* near the fixing apparatus 17, where it is entrained on the driving roller 14*d*.

The primary transfer unit 14*c* as a primary transfer means is a corona discharging unit provided opposite to the photoreceptor drum 10 with the intermediate transfer belt 14*a* positioned in between, and forms a transfer area 14*b* between the intermediate transfer belt 14*a* and the photoreceptor drum 10. By applying a direct current voltage of the opposite polarity to the toner (positive polarity in this embodiment) to the primary transfer unit 14*c*, a toner image on the photoreceptor drum 10 is transferred to the intermediate transfer belt 14*a* or to the front side of the recording paper sheet P, which denotes a transfer material.

The secondary transfer unit 14*g*, which denotes a secondary transfer means, should desirably be made up of a corona discharging unit, and is provided opposite to the grounded roller 14*j* with the intermediate transfer belt 14*a* positioned in between, the grounded roller 14*j* being provided between the primary transfer unit 14*c* and the driving roller 14*d*, and transfers a toner image on the intermediate transfer belt 14*a* to the rear side of the recording paper sheet P with a direct current voltage of the opposite polarity to the toner (positive polarity in this embodiment) applied to the unit 14*g*.

The charge eliminating unit 14*m*, which denotes a charge eliminating means, is provided at the downstream side of the primary transfer unit 14*c* with respect to the moving direction of the intermediate transfer belt 14*a*, being placed side by side, and eliminate the charge on the intermediate transfer belt, which is charged through the voltage application to the primary transfer unit 14*c*, with an alternate current voltage applied to the unit 14*m*.

The paper charging unit 150, which denotes a transfer material charging means, should desirably be made up of a sawtooth electrode, is provided opposite to the grounded driven roller 14*e* with the intermediate transfer belt 14*a* positioned in between, and charges the recording paper sheet P to make it to be attracted to the intermediate transfer belt 14*a* with a direct current voltage of the same polarity as the toner (negative polarity in this embodiment) applied to the unit 150. As for the paper charging unit 150, in addition to the sawtooth electrode, it is possible to use a corona discharging unit or a paper charging brush, a paper charging roller, or the like which is capable of being in contact with and being released from the intermediate transfer belt 14*a*.

The AC charge eliminating unit for detaching a paper sheet 14*h*, which denotes a transfer material detaching means, should desirably be made up of a corona discharging unit, is provided at need at the end portion of the intermediate transfer belt 14*a* near the fixing apparatus 17, opposite to the grounded driving roller 14*d* with the intermediate transfer belt 14*a* positioned in between, and eliminates the charge of the recording paper sheet P transported by the intermediate transfer belt 14*a* to detach it from the intermediate transfer belt 14*a*, with an alternate current voltage, having a direct current voltage of the same polarity as the toner or the opposite polarity to the toner superposed to it at need, applied to the unit 14*h*.

The transporting portion 160 comprises the pick off finger 210, which denotes a finger member, and the spur 162, which denotes a spur member, and is provided between the curvature portion KT at the end portion of the intermediate transfer belt 14*a* near the fixing apparatus 17 and the fixing apparatus 17. The transportation portion 160 prevents that the intermediate transfer belt 14*a* is deformed by the heat from the fixing apparatus 17, the toner image carried by the intermediate transfer belt 14*a* becomes slightly melted and hard to be transferred, and the toner particles are fixed onto the intermediate transfer belt 14*a*.

The pick off finger 210, which denotes a finger member, is provided close to the curvature portion KT of the intermediate transfer belt 14*a*, being fixed to the supporting shaft 221 with a predetermined clearance, desirably 0.1 mm to 2.0 mm, to the intermediate transfer belt 14*a*; when the recording paper sheet P is detached from the intermediate transfer belt 14*a*, the pick off finger 210 is made to be in contact with the leading edge of the recording paper sheet P, which is being transported in the deviated direction to the intermediate transfer belt 14*a*, to help the recording paper sheet P detach.

The spur 162, which denotes a spur member, has a plurality of projected portion 162*a* on the peripheral surface, and is mounted in a manner capable of rotating around the rotatable supporting shaft 165. The spur 162 transports the recording paper sheet P guiding the rear side of it, and prevents the disturbance of the rear side toner image of the recording paper sheet P having toner images on both sides, while it transports the recording paper sheet P to the fixing apparatus 17 stably, making it constant the entering direction of the recording paper sheet P into the fixing apparatus 17.

The pick off finger 210 and the spur 162 are disposed at the opposite side of the photoreceptor drum with respect to the plane of transportation for the transfer material on the intermediate transfer belt or the extended plane of it. It is possible to provide the spurs 162, which are spur members, at the both sides of the plane of transportation for the transfer material or the extended plane of it.

The fixing apparatus 17, which is a fixing means, is composed of two roller-shaped fixing members, namely, the first fixing roller 17*a* having a heater inside and the second fixing roller 17*b*, transports the recording paper sheet P held by the nip portion T between the first fixing roller 17*a* and the second fixing roller 17*b*, and fixes the toner image on the recording paper sheet P which is being transported in the nip portion T by applying heat and pressure. On the first fixing roller 17*a* and the second fixing roller 17*b*, the high-resistance layers 173*a* and 173*b*, which will be described later in detail, are provided as surface layers respectively, and bias voltages, which will also be described in detail later, are applied to them respectively.

In the following, the image forming process will be explained.

When image forming is started, the photoreceptor drum 10 is rotated in the clockwise direction shown by the arrow mark in FIG. 5 by the starting of the photoreceptor driving motor, which is not shown in the drawing, and at the same time, it is started to give an electric potential to the photoreceptor drum 10 by the charging action of the scorotron charger 11 for yellow (Y).

After the photoreceptor drum 10 is given an electric potential, it is started the image writing by the first color signal, that is, the electric signal corresponding to image data for Y by the exposure optical system for Y, and a latent electrostatic image corresponding to the Y component of the original image is formed on the surface of the photoreceptor drum 10.

The above-mentioned latent image is reverse-developed in a non-contact condition by the developing unit 13 for Y, and the yellow (Y) toner image is formed on the surface of the photoreceptor drum 10.

Next, the photoreceptor drum 10 is given an electric potential from over the Y toner image by the charging action of the scorotron charger 11 for magenta (M), and is subjected to the image writing by the second color signal, that is, the electric signal corresponding to the image data for M by the exposure optical system 12 for M; thus, a magenta (M) toner image is formed being superposed on the aforesaid yellow (Y) toner image by the non-contact reverse development by the developing unit 13 for M.

Further, through the similar process, by the scorotron charger 11 for cyan (C), the exposure optical system 12 for C, and the developing unit 13 for C, the cyan (C) toner image corresponding to the third color signal is formed being superposed, and furthermore, the black (K) toner image corresponding to the fourth color signal is formed being successively superposed on it by the scorotron charger 11 for black (K), the exposure optical system 12 for K, and the developing unit 13 for K; thus, within one rotation of the photoreceptor drum 10, the four color, namely, yellow (Y), magenta (M), cyan (C), and black (K) superposed toner images are formed on it (toner image forming means).

The image writing by these exposure optical systems for Y, M, C, and K to the photosensitive layer of the photoreceptor drum 10 is carried out from the inside of the drum through the above-described transparent substrate. Accordingly, the image writing processes corresponding to the second, third, and fourth color signal are not influenced at all by the toner images formed previously, and it is possible to form latent images of quite the same quality as the image corresponding to the first color signal.

The superposed color toner images, which will become the rear side image, formed on the photoreceptor drum 10 by the above-mentioned image forming process are transferred all at a time in the transfer area 14*b* (primary transfer A) onto the intermediate transfer belt 14*a* as an intermediate transfer member by the primary transfer unit 14*c* as a primary transfer means for transferring to the intermediate transfer member (FIG. 7(*a*)). At this time, it may be appropriate to carry out a uniform exposure by the exposure unit acting simultaneously with transfer 12*d* provided inside the photoreceptor drum 10 in order to make a satisfactory transfer.

After being subjected to the charge elimination by the AC charge eliminating unit for the photoreceptor drum 16, toner particles which remain on the photoreceptor drum 10 after transfer come to the cleaning apparatus 19, which denotes a image carrying member cleaning means, where they are removed by the cleaning blade 19*a*, which is in contact with the photoreceptor drum 10 and made up of a rubber material, and are collected in a waste toner container not shown in the drawing by the screw 19*b*. Further, with respect to the photosensitive layer of the photoreceptor drum 10, the hysteresis phenomenon owing to the previous image forming is eliminated by the exposure to the light from the pre-charging uniform exposure unit 12*e* using light emitting diodes for example.

After the superposed color toner images which will become the rear side image are formed on the intermediate transfer belt 14*a* in the above-described manner, the superposed color toner images which will become the front side image are successively formed on the photoreceptor drum 10 in the same way as the above-described color image forming process (FIG. 7(*b*)). At this time, for the front side image to be formed on the photoreceptor drum 10, the image data are modified to make it converted left-to-right with respect to the above-mentioned rear side image which has been formed on the photoreceptor drum 10.

With the formation of the front side image on the photoreceptor drum 10 proceeding, the recording paper sheet P, which denotes a transfer material, is conveyed out from the paper feeding cassette 15, which denotes a transfer material receiving means, by the conveying-out roller 15*a*, is transported to the timing roller 15*b* as a transfer material feeding means, and is fed to the transfer area 14*b* by the driving of the timing roller 15*b* in synchronism with the color toner images being formed on the photoreceptor drum 10 and the color toner images for the rear side image being carried by the intermediate transfer belt 14*a*. At this time, the recording paper sheet P fed to the area 14*b* is charged to the same polarity as the toner by the paper charging unit 150, which denotes a transfer material charging means, provided to the front side of the recording paper sheet P, and is transported to the transfer area 14*b* being attracted to the intermediate transfer belt 14*a*. By carrying out the paper charging to the same polarity as the toner, it is prevented that the paper sheet attracts the toner images on the intermediate transfer belt 14*a* and the toner images on the photoreceptor drum 10, and that prevents the disturbance of the toner images.

The toner images for the front side on the photoreceptor drum are transferred in the transfer area 14*b* all at a time to the front side of the recording paper sheet P by the primary transfer unit 14*c* to which an electric voltage of the opposite polarity to the toner (positive polarity in this embodiment) is applied. At this time, the toner images for the rear side on the intermediate transfer belt 14*a* are not transferred to the recording paper sheet P but remain on the intermediate transfer belt 14*a*. On this occasion, it may be appropriate to carry out a uniform exposure, by the exposure unit acting simultaneously with transfer 12*d* using light emitting diodes for example provided inside the photoreceptor drum 10 opposite to the transfer area, in order to make a good transfer. Further, the charge on the intermediate transfer belt 14*a* given by the primary transfer unit 14*c* is eliminated by the charge eliminating unit 14*m*.

The recording paper sheet P having color toner images transferred on its front side is transported to the secondary transfer unit 14*g* as a secondary transfer means to which an electric voltage of the opposite polarity to the toner (positive polarity in this embodiment), where the toner images for the rear side on the peripheral surface of the intermediate transfer belt 14*a* are transferred all at a time to the rear side of the recording paper sheet P (secondary transfer) by the secondary transfer unit 14*g* (FIG. 7(*c*)).

The recording paper sheet P having the color toner images on its both sides formed is detached from the intermediate transfer belt 14*a*, by the curvature of the curvature portion KT of the intermediate transfer belt 14*a*, the charge eliminating action of the AC charge eliminating unit for detaching a paper sheet 14*h* as a transfer material detaching means provided at the end portion of the intermediate transfer belt 14*a* at need, and the pick off finger 210 provided in the transporting portion 160 with a predetermined clearance to the intermediate transfer belt 14*a*, is transported to the fixing apparatus 17 as a fixing means through the spur 162 provided in the transporting portion 160, and is transported through the nip portion T between the first fixing roller 17*a* and the second fixing roller 17*b*, where the toner images on the recording paper sheet P are fixed by the application of heat and pressure. The recording paper sheet P which has been subjected to two-sided image recording is transported with the upside inverted down, and is ejected to a tray outside the apparatus by the paper ejecting roller 18.

The toner particles remain on the peripheral surface of the intermediate transfer belt 14*a* after transfer is removed by the intermediate transfer member cleaning apparatus 140, which denotes an intermediate transfer member cleaning means, having the intermediate transfer member cleaning blade 141 capable of being in contact with and being released from the intermediate transfer belt 14*a* with the supporting shaft 142 made as a center axis of rotation, provided opposite to the guide roller 14*f* with the intermediate transfer belt 14*a* positioned in between.

Further, after being subjected to the charge elimination by the AC charge eliminating unit for a photoreceptor drum 16, the toner particles remaining on the peripheral surface of the photoreceptor drum 10 after transfer, are removed by the cleaning apparatus 19, and the hysteresis phenomenon in the photoreceptor drum 10 owing to the previous image forming process is eliminated by the pre-charging uniform exposure unit 12*e*; then, the photoreceptor drum enters next image forming cycle.

Because the superposed color toner images are transferred all at a time by using the above-described method, color deviation in the color image on the intermediate transfer belt 14*a*, toner scattering, toner image rubbing, etc. seldom occur, and a satisfactory two-sided color image forming with little image deterioration can be performed.

In the above-described two-sided image forming apparatus, the intermediate transfer belt 14*a* is an endless belt having a medium resistance as a volume resistivity of $10^{10}$ Ω·cm, and the photoreceptor drum 10 and the intermediate transfer belt 14*a* are driven to rotate at a linear velocity V=280 mm/sec. Under these conditions, by setting the optimum transfer currents I(1B), I(1A), and I(2) in the primary transfer B, primary transfer A, and the secondary transfer respectively at values satisfying the following inequalities respectively, a satisfactory high-efficiency transfer is performed in any one of the cases, and a satisfactory two-sided image forming can be carried out.

(1) The primary transfer current I(1B) (μA) when the toner images on the photoreceptor drum 10 are transferred to the front side of the recording paper sheet P by the primary transfer unit 14*c*, which denotes a primary transfer means, should satisfy the following inequality condition:

$$56 \leqq I(1B) \leqq 196 (\text{or } 0.2 \leqq I(1B)/V \leqq 0.7),$$

and should desirably satisfy the following inequality condition:

$$84 \leqq I(1B) \leqq 168 (\text{or } 0.3 \leqq I(1B)/V \leqq 0.6),$$

and by setting that I(1B)=136 μA in this embodiment, a ghost image never appears and transfer with a satisfactory efficiency can be performed.

(2) The primary transfer current I(1A) (μA) when the toner images on the photoreceptor drum 10 are transferred to the intermediate transfer belt 14*a* by the primary transfer unit 14*c*, which denotes a primary transfer means, should satisfy the following inequality condition:

$$0.4 \times I(1B) \leqq I(1A) \leqq 0.8 \times I(1B),$$

and should desirably satisfy the following inequality condition:

$$0.5 \times I(1B) \leqq I(1A) \leqq 0.7 \times I(1B),$$

and by setting that I(1A)=82 μA in this embodiment, transfer with a satisfactory efficiency can be performed.

(3) The secondary transfer current I(2) (μA) when the toner images on the intermediate transfer belt 14*a* are transferred to the rear side of recording paper sheet P by the secondary transfer unit 14*g*, which denotes a secondary transfer means, should satisfy the following inequality condition:

$$0.6 \times I(1B) \leqq I(2) \leqq 1.4 \times I(1B) (\text{or } 0.12 \leqq I(2)/V \leqq 0.98),$$

and should desirably satisfy the following inequality condition:

$$0.8 \times I(1B) \leqq I(2) \leqq 1.2 \times I(1B) (\text{or } 0.16 \leqq I(2)/V \leqq 0.84),$$

and by setting that I(2)=136 μA in this embodiment, transfer with a satisfactory efficiency can be performed without the disturbance of the toner images.

Embodiment 2

Figure 8:
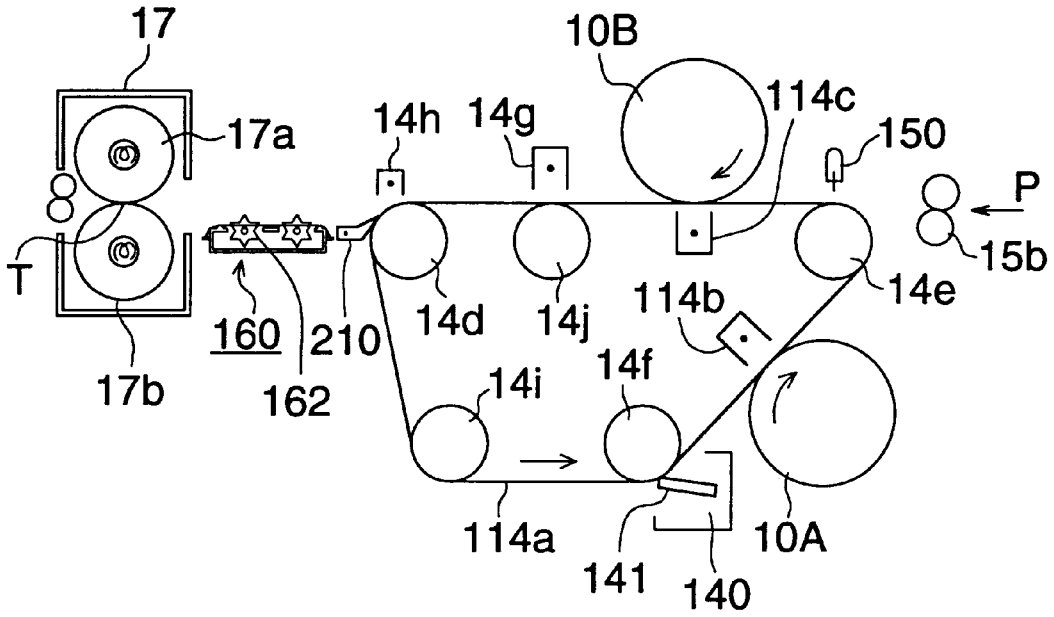
FIG. 8 is a drawing showing the outline of the structure of a two-sided image forming apparatus of the embodiment 2.

A two-sided image forming apparatus of this invention will be explained with reference to the drawing showing the outline of the structure in FIG. 8. Incidentally, for the members having the same function as those in the embodiment 1 shown in FIG. 5, a part of them are indicated by the same sign. As shown in FIG. 8, in the image forming apparatus of this embodiment, two-sided images are obtained in the following way:

The photoreceptor drum 10A, which denotes a first image carrying member for forming the toner images to make the rear side image (toner images for the rear side), and the photoreceptor drum 10B, which denotes a second image carrying member for forming the toner images to become the front side image (toner images for the front side), are separately provided, and after transferring the toner images for the rear side formed on the photoreceptor drum 10A onto the intermediate transfer belt 114*a*, which denotes an intermediate transfer member, by the first primary transfer unit 114A denoting a first primary transfer means to which an electric voltage of the opposite polarity to the toner (positive polarity in this embodiment) is applied (first primary transfer), the recording paper sheet P, which denotes a transfer material, is fed onto the intermediate transfer belt 114*a* between the photoreceptor drum 10A and the photoreceptor drum 10B, and is transported being attracted to the intermediate transfer belt 114*a* by the charging of the paper charging unit 150 provided opposite to the grounded driven roller 14*e* with the intermediate transfer belt 114*a* positioned in between; the toner images for the front side formed on the photoreceptor drum 10B are transferred to the front side of the recording paper sheet P by the second primary transfer unit 114B denoting a second primary transfer means to which an electric voltage of the opposite polarity to the toner (positive polarity in this embodiment) is applied (second primary transfer). After that, the toner images for the rear side on the intermediate transfer belt 114*a* are transferred to the rear side of the recording paper sheet P by the secondary transfer unit 14*g* denoting a secondary transfer means to which an electric voltage of the opposite polarity to the toner (positive polarity in this embodiment) is applied (secondary transfer); thus, the toner images for the front and rear side are formed on the recording paper sheet P, and the recording paper sheet P having the color toner images formed on both sides is detached from the intermediate transfer belt 114*a* by the curvature at the curvature portion KT of the intermediate transfer belt 114*a*, the charge eliminating action of the AC charge eliminating unit for detaching a paper sheet 14*h* as a transfer material detaching means provided at the end portion of the intermediate transfer belt 114*a* at need, and the pick off finger 210 provided in the transporting portion 160 with a predetermined clearance to the intermediate transfer belt 114*a*; then it is transported to the fixing apparatus 17 as a fixing means through the spur 162 denoting a spur member provided in the transporting portion 160, and the toner images on the recording paper sheet P are fixed at the nip portion T between the first fixing roller 17*a* and the second fixing roller 17*b*.

For the photoreceptor drums 10A and 10B and the intermediate transfer belt 114*a* in the image forming apparatus of this example, ones having the same function and the same structure as the photoreceptor drum 10 and the intermediate transfer belt 14*a* which have been explained in the aforesaid image forming apparatus. The intermediate transfer belt 114*a* is entrained around the roller members, namely, the driving roller 14*d*, the grounded roller 14*j*, the driven roller 14*e*, the guide roller 14*f*, and the tension roller 14*i*, and the intermediate transfer member cleaning apparatus 140 is provided opposite to the guide roller 14*f* with the intermediate transfer belt positioned in between to carry out the removal of the residual toner particles. In this embodiment, it is of no problem that the cleaning blade 141 is always in the contact state.

For the toner image forming means for forming toner images to make the rear side image on the photoreceptor drum 10A denoting a first image carrying member (first toner image forming means), and the toner image forming means for forming toner images to make the front side image on the photoreceptor drum 10B denoting a second image carrying member (second toner image forming means), the four sets of developing units 13 (developing means), the scorotron chargers 11 (charging means), and the exposure optical systems 12 (image writing means) for use in the image forming processes for yellow (Y), magenta (M), cyan (C), and black (K) respectively are used for each of the photoreceptor drums 10A and 10B, and the toner images for the rear side image and the toner images for the front side image are formed on them respectively.

In the two-sided image forming apparatus of this embodiment, by providing the photoreceptor drums 10A and 10B, and the first primary transfer unit 114A provided opposite to the photoreceptor drum 10A and the second primary transfer unit 114B provided opposite to the photoreceptor drum 10B, the toner images for the front side image formed on the photoreceptor drum 10B are transferred onto the front side of the recording paper sheet P (second primary transfer) successively without waiting for one revolution of the intermediate transfer belt, after the toner images for the rear side image formed on the photoreceptor drum 10A are transferred onto the intermediate transfer belt 114*a* (first primary transfer); therefore, the print speed (the number of prints per hour) can be made higher than that in the embodiment.

The second primary transfer in this embodiment corresponds to the primary transfer B in the embodiment 1, and the transfer current $I_2$(1B) corresponds to the transfer current I(1B) in the primary transfer B.

Further, the first primary transfer in this embodiment corresponds to the primary transfer A in the embodiment 1, and the .r transfer current $I_1$(1A) in the first primary transfer corresponds to the transfer current I(1A) in the primary transfer A.

Furthermore, the transfer current I(2) in the secondary transfer by the secondary transfer unit 14*g* is the same for both of this embodiment and the embodiment 1, and is indicated by the same sign.

Accordingly, for the suitable transfer current values in this embodiment, $I_2$(1B) and $I_1$(1A) which are substituted for the I(1B) and I(1A) in the embodiment 1 respectively can be applied straightforwardly. This embodiment should not be confined to the embodiments 1 and 2, but can be applied also to a monochromatic two-sided image forming apparatus employing a similar process to that explained with reference to FIG. 5 or FIG. 8.

Besides, in the two-sided image forming apparatus of this invention, in addition to the two-sided image forming as explained in each of the above-described two-sided image forming apparatus, wherein images are formed on both sides of a transfer material, single-sided image forming, in which an image is formed only on the front side or on the rear side of a transfer material, can be performed.

In summary, by using the two-sided image forming apparatus explained with reference to the above-described FIG. 5 or FIG. 8, the points of problem in the two-sided image forming apparatus using a conventional duplex reversible paper feeding apparatus, that is:

(1) first print speed is low in making a two-sided copy;

(2) reliability in transporting a paper sheet (a transfer material), and a paper jam is easy to occur;

(3) in case a paper jam occurs, owing to a long paper path, the number of paper sheets to become useless is large, and jam disposal is hard to make;

(4) there is a limit in the kinds of paper to be applied; a thick paper, a thin paper, a small-sized paper such as a postcard, and a paper sheet having an abnormal shape can not be coped with;

(5) paper path is contaminated by the fixing oil, and in particular, it poses a problem in the case of color copying;

(6) heat is conveyed into the inside of the apparatus mainframe, which makes the process unstable;

and so forth are solved, and the invention has the following effects:

(1) Owing to no waiting time for inverting a paper sheet (a transfer material), it becomes possible to successively carry out image forming on the both sides of the paper sheet, which makes the first print speed high.

(2) Because it is not necessary to feed again the paper sheet after passing the fixing means, the reliability of paper feeding is greatly improved. Further, contamination of the paper path by the fixing oil and the conveyance of heat into the inside of the apparatus mainframe is eliminated.

(3) Because two-sided printing can be done by quite the same paper feeding system as the single-sided printing, limit to the kinds of transfer materials is removed.

(4) Because no paper inverting path is provided, the number of paper sheets to become useless on the occasion of occurrence of a paper jam is small, and the disposal of a paper jam is easy.

(5) Because the number of paper sheets passing through the fixing means in two-sided printing becomes a half of that in single-sided printing for the same number of images, the power consumption in fixing can be reduced.

According to this invention, an intermediate transfer member having a suitable volume resistivity is used, and the transfer currents in the primary transfer of the toner images on the image carrying member to the intermediate transfer member, in the primary transfer of the toner images on the image carrying member to the front side of a transfer material, and in the secondary transfer of the toner images on the intermediate transfer member to the rear side of a transfer material are set at values satisfying the optimum conditions respectively; hence, by executing the control of the transfer currents for the determined current values, it has become possible to make the two-sided images finally formed on the transfer material both have no ghost and no disturbance of the toner image, and to obtain two-sided images formed with a high transfer efficiency.

Figure 11:
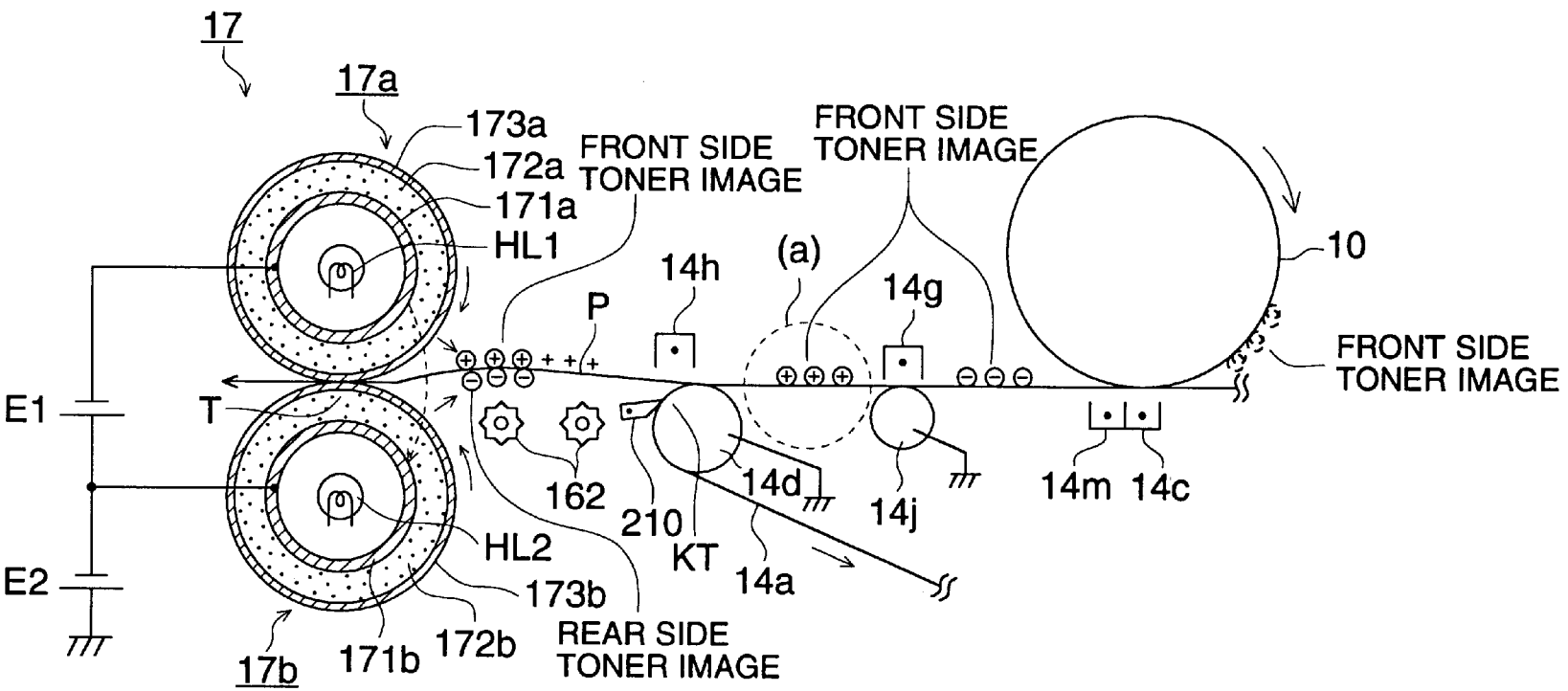
FIG. 11 is a drawing showing the structure of fixing members used in a fixing means and the application of electric voltages to the fixing members for preventing the disturbance of a toner image on a transfer material.
Figure 12:
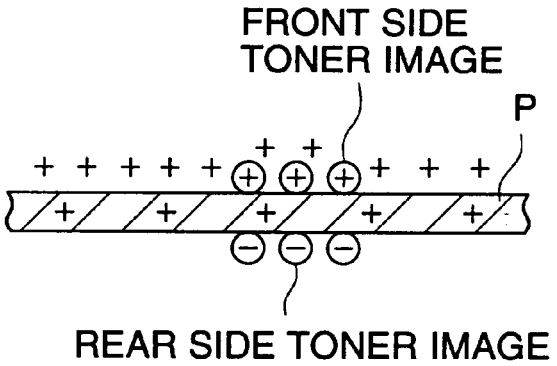
FIG. 12 is a drawing showing how a transfer material and toner particles on it are charged after toner images are transferred to the both sides of the transfer material.
Figure 13:
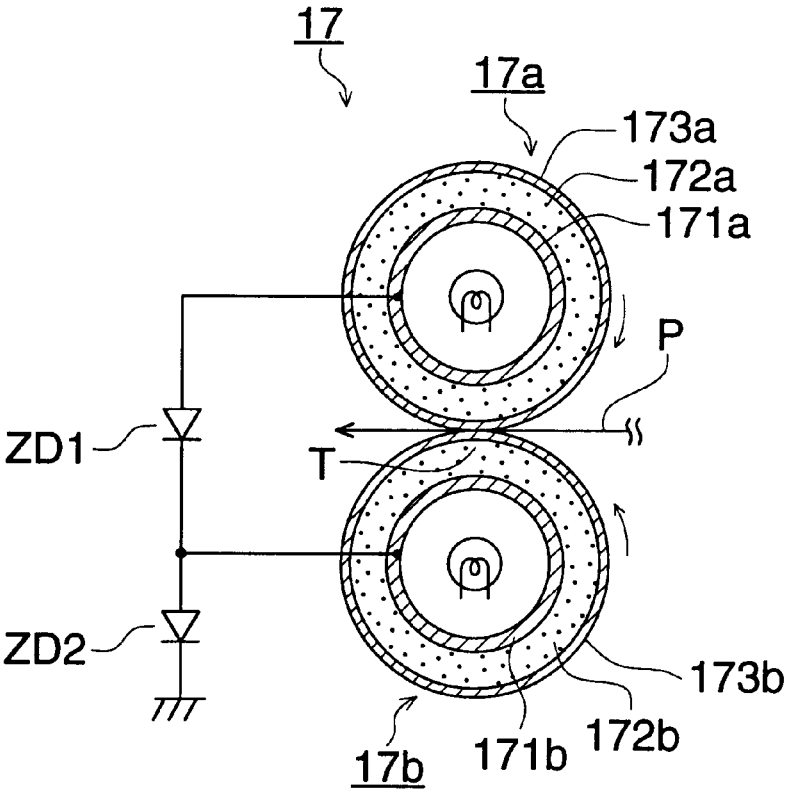
FIG. 13 is a drawing showing another example of preventing the disturbance of a toner image on a transfer material.

FIG. 11 is a drawing showing the structure of fixing members for use in a fixing means and application of electric voltages to fixing members for preventing the disturbance of the toner image, FIG. 12 is a drawing showing how a transfer material and toner images on the transfer material are charged after the toner images are transferred to the both sides of the transfer material, and FIG. 13 is a drawing showing another example for preventing the disturbance of toner images on a transfer material.

As shown in FIG. 11, the structure of the first fixing roller 17*a* and the second fixing roller 17*b*, which denote two roll-shaped fixing members provided in the fixing apparatus 17 denoting a fixing means for use in the aforesaid image forming apparatus, is one such that the first fixing roller 17*a* for fixing the toner images on the upper side (front side) of the recording paper sheet P and the second fixing roller 17*b* for fixing the toner images on the lower side (rear side) are rotating members having both approximately the same structure provided with the halogen heaters HL1 and HL2 at the central portions of their insides respectively. The first fixing roller 17*a* having the halogen heater HL1 at its central portion is made up as a soft roller formed of the cylindrical metallic pipe 171*a* using an aluminum material for example, the rubber roller layer 172*a* made of a thin rubber layer having a thickness of 1 mm to 3 mm using a silicone material for example provided on the outer circumferential surface of said metallic pipe 171*a*, and the high-resistance layer 173*a*, which is heat resistant, has a releasing property and is made of a fluorine resin such as PFA and PTFE or a silicone resin, having a thickness of 0.05 mm to 0.25 mm and a volume resistivity R (Ω·cm) of $10^{10}$ Ω·cm to $10^{16}$ Ω·cm, which is higher than that of the above-described intermediate transfer belt 14*a* (not less than $10^{9}$ Ω·cm and less than $10^{12}$ Ω·cm) and that of the recording paper sheet P denoting a transfer material ($10^{8}$ Ω·cm to $10^{12}$ Ω·cm which is approximately the same as or slightly less than that of the intermediate transfer belt 14*a*), provided on the surface of said rubber roller layer 172*a*. In the same manner, the second fixing roller 17*b* having the halogen heater HL2 at its central portion is made up as a soft roller formed of the cylindrical metallic pipe 171*b* using an aluminum material for example, the rubber roller layer 172*b* made of a thin rubber layer having a thickness of 1 mm to 3 mm using a silicone material for example provided on the outer circumferential surface of said metallic pipe 171*b*, and the high-resistance layer 173*b*, which is heat resistant, has a releasing property, and is made of a fluorine resin such as PFA and PTFE or a silicone resin, having a thickness of 0.05 mm to 0.25 mm and-a volume resistivity of $10^{10}$ Ω·cm to $10^{16}$ Ω·cm, provided on the surface of said rubber roller layer 172*b*. By providing the high-resistance layers 173*a* and 173*b* having a volume resistivity higher than those of the recording paper sheet P and the intermediate transfer belt 14*a* on the fixing members in the fixing apparatus 17, it is prevented the leakage of electric charge, which occurs in the cases where the electric resistance of the fixing members is low and either or both of the fixing members are grounded, from the recording paper sheet P and the intermediate transfer belt 14*a* through the fixing members, and it is also prevented that transfer of the toner images for the rear side is not performed satisfactorily owing to the leakage of the electric charge from the recording paper sheet P through the fixing members, at the time of transferring the toner images for the rear side by the secondary transfer unit 14*g* disposed in the vicinity of the fixing apparatus 17.

According to FIG. 11, the recording paper sheet P denoting a transfer material is fed to the transfer area 14*b* in synchronism with the color toner images for the front side image (having a negative polarity in this embodiment) being formed on the photoreceptor drum 10 and the color toner images for the rear side image carried on the intermediate transfer belt 14*a* (having a negative polarity in this embodiment), and the toner images for the front side on the photoreceptor drum 10 are transferred all at a time to the front side of the recording paper sheet P in the transfer area 14*b* by the primary transfer unit 14*c* to which a direct current voltage of the opposite polarity to the toner (positive polarity in this embodiment) is applied. At this time, because the toner images for the front side of the recording paper sheet P is transferred with the intermediate transfer belt 14*a* (having a volume resistivity R (Ω·cm) of not less than $10^9$ Ω·cm and less than $10^{12}$ Ω·cm) positioned in between, the toner images for the front side are kept in the negative polarity without being converted for its charge polarity. Further, after the electric charge on the intermediate transfer belt 14*a* charged to the positive polarity by the primary transfer unit 14*c* is eliminated by the charge eliminating unit 14*m* to which an alternate current voltage is applied, the toner images for the rear side on the intermediate transfer belt 14*a* are further transferred to the rear side of the recording paper sheet P by the secondary transfer unit 14*g* to which a direct current voltage of the opposite polarity to the toner (positive polarity in this embodiment) is applied; the situation of charging of the toner images on the front and rear sides and the recording paper sheet P at the position of the circle (a) shown in FIG. 11 after passing through the secondary transfer unit 14*g* is, as shown in FIG. 12, one such that the toner images on the rear side of the recording paper sheet P are kept in the negative polarity without being converted for its charge polarity, but the front side toner images having the negative polarity on the recording paper sheet P are made to have a positive polarity being converted for its charge polarity owing to the positive-polarity discharging by the secondary transfer unit 14*g*. Further, owing to the positive-polarity discharging by the secondary transfer unit 14*g*, the front side of the recording paper sheet P is positively charged, and owing to the low volume resistivity of the recording paper sheet P, the positive charge penetrates into the central portion of the inside or reaches to the back side (rear side) of the recording paper sheet P. At this time, the electric potential of the recording paper sheet P has a positive polarity and charging comes up to a potential of 1 kV to 2 kV.

The recording paper sheet P having the color toner images on its both sides formed is detached from the intermediate transfer belt 14*a*, by the curvature of the curvature portion KT of the intermediate transfer belt 14*a*, the charge eliminating action of the AC charge eliminating unit for detaching a paper sheet 14*h* as a transfer material detaching means, with an alternate current voltage having it superposed a direct current voltage of the same polarity as the direct current voltage applied to the secondary transfer unit 14*g* (positive polarity in this embodiment as described above in FIG. 12) applied to it, provided at the end portion of the intermediate transfer belt, and the pick off finger 210, is transported to the fixing apparatus 17 as a fixing means through the spur 162 denoting a spur member, and is transported through the nip portion T between the first fixing roller 17*a* and the second fixing roller 17*b*, where the toner images on the recording paper sheet P are fixed by the application of heat and pressure, with the recording paper sheet P forming a loop in the state of being held between the rollers in the nip portion T, while the above-mentioned electric charge having the positive polarity of 1 kV to 2 kV on the recording paper sheet P given by the secondary transfer unit 14*g* is reduced to a potential of about 500V in the positive polarity by the action of the AC charge eliminating unit for detaching a paper sheet 14*h*.

As described in the foregoing, the volume resistivity R (Ω·cm) of the intermediate transfer belt 14*a* denoting an intermediate transfer member is not less than $10^9$ Ω·cm and less than $10^{12}$ Ω·cm, and the volume resistivity of the recording paper sheet P denoting a transfer material is $10^8$ Ω·cm to $10^{12}$ Ω·cm, which is approximately the same as or slightly less than that of the intermediate transfer belt 14*a*; further, the high-resistance layers 173*a* and 173*b* having a volume resistivity of $10^{10}$ Ω·cm to $10^{16}$ Ω·cm which is higher than those of the intermediate transfer belt 14*a* and the recording paper sheet P are provided on the first fixing roller 17*a* and the second fixing roller 17*b*, which are two roll-shaped fixing members provided in the fixing apparatus 17 denoting a fixing means, and by providing the high-resistance layers 173*a* and 173*b* having a higher volume resistivity than the recording paper sheet P and the intermediate transfer belt 14*a* on the fixing members in the fixing apparatus 17, it is prevented the leakage of electric charge, which occurs in the cases where the electric resistance of the fixing members is low or either or both of the fixing members are grounded, from the recording paper sheet P and the intermediate transfer belt 14*a* through the fixing members, and it is also prevented that, at the time of transferring the toner images for the rear side by the secondary transfer unit 14*g* disposed in the vicinity of the fixing apparatus 17, transfer of the toner images for the rear side is not performed satisfactorily owing to the leakage of the electric charge from the recording paper sheet P through the fixing members. Because the grounded roller 14*j* and the driving roller 14*d*, which are grounded, are disposed against the recording paper sheet P with the intermediate transfer belt 14*a* having a volume resistivity R (Ω·cm) of not less than $10^9$ Ω·cm and less than $10^{12}$ Ω·cm positioned in between, the leakage of electric charge from the recording paper sheet P through the grounded roller 14*j* and the diving roller 14*d* does not occur. Further, it is also prevented that, in the case where the volume resistivity of the first fixing roller 17*a* and the second fixing roller 17*b* is low or the either of the fixing members are grounded, the electric image charge of the toners on a transfer material is induced on the fixing members, and the toner images on the front and rear sides of the transfer material are disturbed by the image charge, which makes a satisfactory two-sided images not be formed.

On the other hand, in the case where the fixing members are formed of an insulating material, it brings about a problem that electric charge is accumulated on the fixing members, and the accumulated charge disturbs the toner images on the front and rear sides of a transfer material, which makes a satisfactory two-sided images not be formed, that is, what is called the disturbance of the toner images on the front and rear sides by the fixing apparatus 17. In order to prevent this, an electric voltage of 500V to 1000V is applied to the first fixing roller 17*a* as the fixing member for the front side by the direct current power source E1 having the same polarity as the charge polarity of the recording paper sheet P entering the nip portion T (positive polarity in this embodiment as described in FIG. 12), and an electric voltage of 100 V to 900 V of positive polarity is applied to the second fixing member 17*b* as the fixing member for the rear side by the direct current power source E2, in order that the voltage difference between the first fixing roller 17*a* as the fixing member for the front side and the second fixing member 17*b* as the fixing member for the rear side may be made to be in the range of 200V to 600V. In addition, the polarity of the electric voltage applied to the second fixing roller 17*b* for the rear side is explained as positive in the above; however, the essential point is to make the voltage difference be in the range of 200 V to 600 V, and it may be appropriate to apply a negative voltage or zero voltage as long as the above condition is satisfied. The reason for providing a potential difference between the fixing members for the front and rear sides is as follows:

Because the absolute value of the electric potential of the solid area portion of each front or rear side toner image is 100 V to 200 V (the front side toner image has a positive polarity and the rear side toner image has a negative polarity as explained in FIG. 12) to generate a potential difference of 200 V to 400 V between the front and rear side toner images in the solid areas, by providing the above-mentioned potential difference between the front and rear side fixing members to generate an electric field having a direction from the first fixing roller 17*a* for the front side to the second fixing roller 17*b* for the rear side as shown by the dotted arrow mark in FIG. 11, the toner image on the front side of the recording paper P having the positive polarity and the toner image on the rear side of the recording paper P having the negative polarity are held on the recording paper sheet P by said electric field having a positive polarity for the front side and a negative polarity for the rear side in such a manner as to be pushed toward the front and rear surfaces respectively, hence the attachment of toner particles to the fixing members and smudging of the surrounding by toner scattering can be prevented.

Further, as shown in FIG. 13, without using the direct current power sources E1 and E2, it is also possible to prevent the attachment of toner particles to the fixing members and the smudging of the surrounding, with a structure in which the first fixing roller 17*a* and the second fixing roller 17*b* are kept at the same electric potential as that of the recording paper sheet P grasped in the nip portion T by connecting the zener diodes ZD1 and ZD2 to the first fixing roller 17*a* for the front side and to the second fixing roller 17*b* for the rear side respectively to keep the toner images on the front and rear sides being held on the surfaces of the recording paper sheet P.

By the above-mentioned structure, the leakage of charge from the transfer material is prevented to make the transfer of the rear side toner images be performed satisfactorily, while the disturbance of the toner images on the front and rear sides by the fixing members and the repulsion of the toner particles on the front and rear sides are prevented, and satisfactory two-sided images can be formed.

Figure 14:
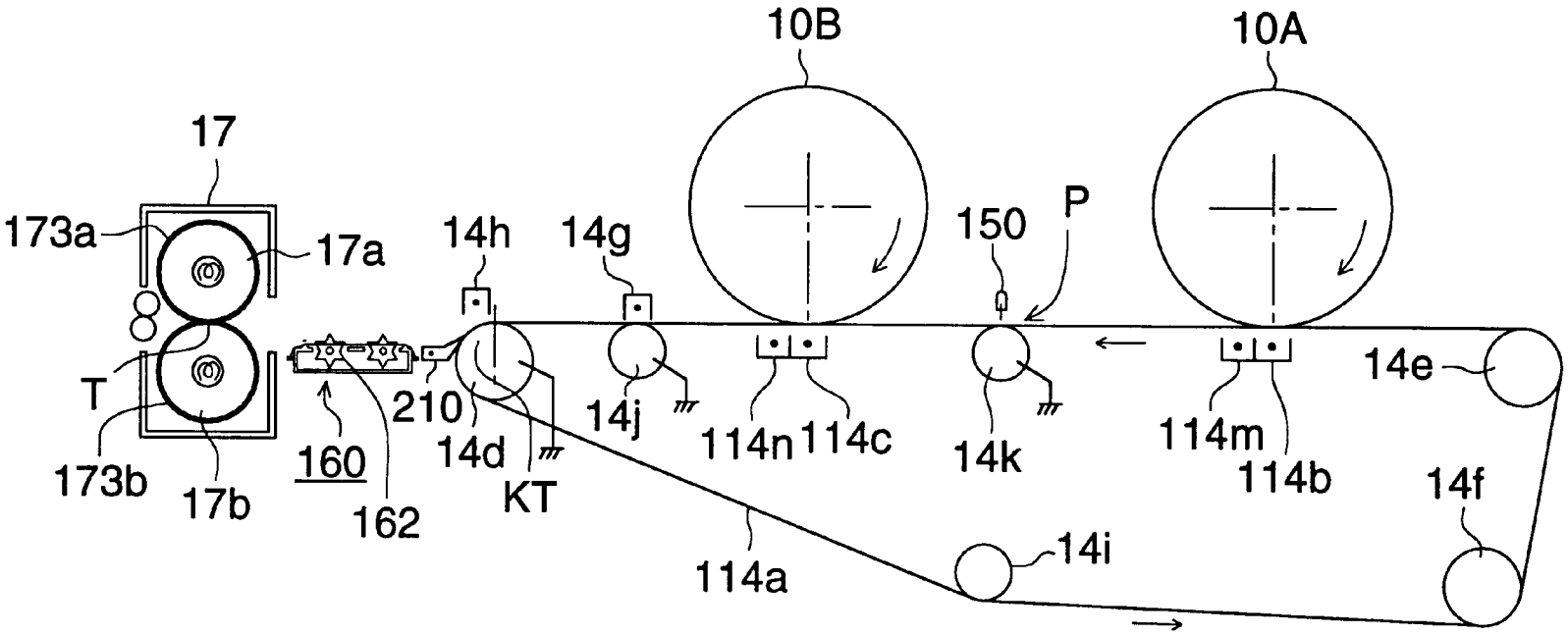
FIG. 14 is a drawing illustrating the outline of a color image forming apparatus showing another embodiment of an image forming apparatus of this invention.

Another embodiment of an image forming apparatus of this invention will be explained with reference to FIG. 14. FIG. 14 is a drawing illustrating the outline of a color image forming apparatus showing another embodiment of an image forming apparatus of this invention.

As shown in FIG. 14, in an image forming apparatus of this example, two-sided images are obtained in the following way:

The photoreceptor drum 10A, which denotes a first image carrying member for forming the toner images to make the rear side image (toner images for the rear side), and the photoreceptor drum 10B, which denotes a second image carrying member for forming the toner images to make the front side image (toner images for the front side), are separately provided, and after transferring the toner images for the rear side formed on the photoreceptor drum 10A onto the intermediate transfer belt 114*a*, which denotes an intermediate transfer member, by the first primary transfer unit 114*b* to which an electric voltage of the opposite polarity to the toner (positive polarity in this embodiment) is applied, the recording paper sheet P, which denotes a transfer material, is fed onto the intermediate transfer belt 114*a* between the photoreceptor drum 10A and the photoreceptor drum 10B, and is transported being attracted to the intermediate transfer belt 114*a* by the charging of the paper charging unit 150 provided opposite to the grounded roller 114*k* with the intermediate transfer belt 114*a* positioned in between; the toner images for the front side formed on the photoreceptor drum 10B are transferred to the front side of the recording paper sheet P by the second primary transfer unit 114*c* denoting a second primary transfer means to which an electric voltage of the opposite polarity to the toner (positive polarity in this embodiment) is applied. After that, the toner images for the rear side on the intermediate transfer belt 114*a* are transferred to the rear side of the recording paper sheet P by the secondary transfer unit 14*g* to which an electric voltage of the opposite polarity to the toner (positive polarity in this embodiment) is applied; thus, the toner images for the front and rear side are formed on the recording paper sheet P, and the recording paper sheet P having the color toner images formed on both sides is detached from the intermediate transfer belt 114*a* by the curvature at the curvature portion KT of the intermediate transfer belt 114*a*, the charge eliminating action of the AC charge eliminating unit for detaching a paper sheet 14*h* provided at the end portion of the intermediate transfer belt 114*a* at need, and the pick off finger 210 provided in the transporting portion 160 with a predetermined clearance to the intermediate transfer belt 114*a*; then it is transported to the fixing apparatus 17 through the spur 162 denoting a spur member provided in the transporting portion 160, and the toner images on the recording paper sheet P are fixed at the nip portion T between the first fixing roller 17*a* and the second fixing roller 17*b*.

For the photoreceptor drums 10A and 10B and the intermediate transfer belt 114*a* in the image forming apparatus of this example, ones having the same function and the same structure as the photoreceptor drum 10 and the intermediate transfer belt 114*a* which have been explained in the aforesaid image forming apparatus. The intermediate transfer belt 114*a* is entrained around the roller members, namely, the driving roller 14*d*, the grounded roller 14*j*, the grounded roller 14*k*, the driven roller 14*e*, the guide roller 14*f*, and the tension roller 14*i*. Further, the charge eliminating members, namely, the charge eliminating members 114*m* and 114*n* are provided behind the first primary transfer unit 114*b* and the second primary transfer unit 114*c* respectively with respect to the moving direction of the intermediate transfer belt 114*a* being disposed side by side with the first primary transfer unit 114*b* and the second primary transfer unit 114*c* respectively, both having it applied an alternate current voltage with a direct current voltage of the same polarity as or of the opposite polarity to the toner superposed, and eliminate the charge on the intermediate transfer member 114*a* given by the voltage application to the first primary transfer unit 114*b* and the second primary transfer unit 114*c*.

For the toner image forming means for forming toner images to make the rear side image on the photoreceptor drum 10A denoting a first image carrying member, and the toner image forming means for forming toner images to make the front side image on the photoreceptor drum 10B denoting a second image carrying member, the four sets of developing units 13 (developing means), the scorotron chargers 11 (charging means), and the exposure optical systems 12 (image writing means) for use in the image forming processes for yellow (Y), magenta (M), cyan (C), and black (K) respectively are used for each of the photoreceptor drums 10A and 10B, and form the toner images for the rear side image and the toner images for the front side image on them respectively.

Further, also in this example, the first fixing roller 17*a* and the second fixing roller 17*b*, which denote both a fixing member, have a structure similar to that explained in FIG. 11; that is, the high-resistance layers 173*a* and 173*b*, which are heat resistant, have a releasing property, and are made of a fluorine resin such as PFA and PTFE or a silicone resin, having a volume resistivity R (Ω·cm) of $10^{10}$ Ω·cm to $10^{16}$ Ω·cm, which is higher than that of the intermediate transfer belt 114*a* (not less than $10^{9}$ Ω·cm and less than $10^{12}$ Ω·cm) and that of the recording paper sheet P denoting a transfer material ($10^{8}$ Ω·cm to $10^{12}$ Ω·cm which is approximately the same as or slightly less than that of the intermediate transfer belt 114*a*) are provided respectively on the first fixing roller 17*a* and the second fixing roller 17*b* as surface layers. By providing the high-resistance layers 173*a* and 173*b* having a volume resistivity higher than those of the recording paper sheet P and the intermediate transfer belt 114*a* on the fixing members in the fixing apparatus 17, it is prevented the leakage of electric charge, which occurs in the case where the electric resistance of the fixing members is low or either or both of the fixing members are grounded, from the recording paper sheet P and the intermediate transfer belt 114*a* through the fixing members, and it is also prevented that transfer of the toner images for the rear side is not performed satisfactorily owing to the leakage of the electric charge from the recording paper sheet P through the fixing members, at the time of transferring the rear side toner images by the secondary transfer unit 14*g* disposed in the vicinity of the fixing apparatus 17.

The recording paper sheet P denoting a transfer material is fed to the transfer area in synchronism with the color toner images for the front side image (having a negative polarity in this embodiment) being formed on the photoreceptor drum 10*a* and the color toner images for the rear side image carried on the intermediate transfer belt 114*a* (having a negative polarity in this embodiment), and the toner images for the front side on the photoreceptor drum 10B are transferred all at a time to the front side of the recording paper sheet P in the transfer area by the second primary transfer unit 114*c* to which a direct current voltage of the opposite polarity to the toner (positive polarity in this embodiment) is applied. At this time, because the toner images for the front side of the recording paper sheet P is transferred with the intermediate transfer belt 114*a* (having a volume resistivity R (Ω·cm) of not less than $10^{9}$ Ω·cm and less than $10^{12}$ Ω·cm) positioned in between, the toner images for the front side are kept in the negative polarity without being converted for its charge polarity. Further, after the electric charge on the intermediate transfer belt 114*a* charged to a positive polarity by the second primary transfer unit 114*c* is eliminated by the charge eliminating unit 114*n* to which an alternate current voltage is applied, the toner images for the rear side on the intermediate transfer belt 114*a* are further transferred to the rear side of the recording paper sheet P by the secondary transfer unit 14*g* to which a direct current voltage of the opposite polarity to the toner (positive polarity in this embodiment) is applied; the situation of charging of the toner images on the front and rear sides and the recording paper sheet P after passing through the secondary transfer unit 14*g* is, as has been explained in FIG. 12, one such that the toner images on the rear side of the recording paper sheet P are kept in the negative polarity without being converted for its charge polarity, but the front side toner images having the negative polarity on the recording paper sheet P are made to have a positive polarity being converted for its charge polarity owing to the positive-polarity discharging by the secondary transfer unit 14*g*. Further, owing to the positive-polarity discharging by the secondary transfer unit 14*g*, the front side of the recording paper sheet P is positively charged, and owing to the low volume resistivity of the recording paper sheet P, the positive charge penetrates into the central portion of the inside or reaches to the back side (rear side) of the recording paper sheet P. At this time, the electric potential of the recording paper sheet P has a positive polarity and charging comes up to a potential of 1 kV to 2 kV.

The recording paper sheet P having the color toner images on its both sides formed is detached from the intermediate transfer belt 114*a*, by the curvature of the curvature portion KT of the intermediate transfer belt 14*a*, the charge eliminating action of the AC charge eliminating unit for detaching a paper sheet 14*h* as a transfer material detaching means, with an alternate current voltage having it superposed a direct current voltage of the same polarity as the direct current voltage applied to the secondary transfer unit 14*g* (positive polarity in this embodiment as described above in FIG. 12) applied to it, provided at the end portion of the intermediate transfer belt 114*a*, and the pick off finger 210, is transported to the fixing apparatus 17 as a fixing means through the spur 162 denoting a spur member, and is transported through the nip portion T between the first fixing roller 17*a* and the second fixing roller 17*b*, where the toner images on the recording paper sheet P are fixed by the application of heat and pressure, with the recording paper sheet P forming a loop (not shown in the drawing) in the state of being held between the rollers in the nip portion T, while the above-described electric charge having the positive polarity of 1 kV to 2 kV on the recording paper sheet P by the secondary transfer unit 14*g* is reduced to a potential of about 500V in the positive polarity by the action of the AC charge eliminating unit for detaching a paper sheet 14*h*.

As has been explained in the foregoing example, the volume resistivity R (Ω·cm) of the intermediate transfer belt 114*a* denoting an intermediate transfer member is not less than $10^{9}$ Ω·cm and less than $10^{12}$ Ω·cm, and the volume resistivity of the recording paper sheet P denoting a transfer material is $10^{8}$ Ω·cm to $10^{12}$ Ω·cm, which is approximately the same as or slightly less than that of the intermediate transfer belt 114*a*; further, the high-resistance layers 173*a* and 173*b* having a volume resistivity of $10^{10}$ Ω·cm to $10^{16}$ Ω·cm which is higher than those of the intermediate transfer belt 114*a* and the recording paper sheet P are provided respectively on the first fixing roller 17*a* and the second fixing roller 17*b*, which are two roll-shaped fixing members provided in the fixing apparatus 17 denoting a fixing means, and by providing the high-resistance layers 173*a* and 173*b* having a higher volume resistivity than the recording paper sheet P and the intermediate transfer belt 114*a* on the fixing members in the fixing apparatus 17, it is prevented the leakage of electric charge, which occurs in the cases where the electric resistance of the fixing members is low or either or both of the fixing members are grounded, from the recording paper sheet P and the intermediate transfer belt 114*a* through the fixing members, and it is also prevented that transfer of the rear side toner images is not performed satisfactorily owing to the leakage of the electric charge from the recording paper sheet P through the fixing members, at the time of transferring the rear side toner images by the secondary transfer unit 14*g* disposed in the vicinity of the fixing apparatus 17. Because the grounded roller 14*j* and the driving roller 14*d*, which are grounded, are disposed against the recording paper sheet P with the intermediate transfer belt 114*a* having a volume resistivity R (Ω·cm) of not less than $10^9$ Ω·cm and less than $10^{12}$ Ω·cm positioned in between, the leakage of electric charge from the recording paper sheet P through the grounded roller 14*j* and the diving roller 14*d* does not occur. Further, it is also prevented that, in the case where the volume resistivity of the first fixing roller 17*a* and the second fixing roller 17*b* is low or either of the fixing members is grounded, the electric image charge of the toners on the transfer material is induced on the fixing members, and the toner images on the front and rear sides of the transfer material are disturbed by the image charge, which makes a satisfactory two-sided images not be formed.

On the other hand, in the case where the fixing members are formed of an insulating material, it is brought about a problem that electric charge is accumulated on the fixing members, and the accumulated charge disturbs the toner images on the front and rear sides of a transfer material, which makes a satisfactory two-sided images not be formed, that is, what is called the disturbance of the toner images on the front and rear sides by the fixing apparatus 17. In order to prevent this, an electric voltage of 500V to 1000V is applied to the first fixing roller 17*a* as the fixing member for the front side by the direct current power source E1 (refer to FIG. 11, because it is not shown in FIG. 14) having the same polarity as the charge polarity of the recording paper sheet P entering the nip portion T (positive polarity in this embodiment as described in FIG. 12), and an electric voltage of 100 V to 900 V of positive polarity is applied to the second fixing member 17*b* as the fixing member for the rear side by the direct current power source E2 (refer to FIG. 11, because it is not shown in FIG. 14), in order that the voltage difference between the first fixing roller 17*a* as the fixing member for the front side and the second fixing member 17*b* as the fixing member for the rear side may be made to be in the range of 200V to 600V. In addition, the polarity of the electric voltage applied to the second fixing roller 17*b* for the rear side is explained as positive in the above; however, the essential point is to make the voltage difference be in the range of 200 V to 600 V, and it may be appropriate to apply a negative voltage or zero voltage as long as the above condition is satisfied. The reason for providing a potential difference between the fixing members for the front and rear sides is as follows:

Because the absolute value of the electric potential of the solid area portion of each front or rear side toner image is 100 V to 200 V (the front side toner image has a positive polarity and the rear side toner image has a negative polarity as explained in FIG. 12) to generate a potential difference of 200 V to 400 V between the front and rear side toner images in the solid area, by providing the above-mentioned potential difference between the front and rear side fixing members to generate an electric field having a direction from the first fixing roller 17*a* for the front side to the second fixing roller 17*b* for the rear side (refer to FIG. 11, because it is not shown in FIG. 14), the toner images on the front side of the recording paper P having the positive polarity and the toner images on the rear side of the recording paper P having the negative polarity are held on the recording paper sheet P by said electric field having a positive polarity for the front side and a negative polarity for the rear side in such a manner as to be pushed toward the front and rear surfaces respectively, hence the attachment of toner particles to the fixing members and smudging of the surrounding by toner scattering can be prevented.

Further, as explained with reference to FIG. 13, without using the direct current power sources E1 and E2, it is also possible to prevent the attachment of toner particles to the fixing members and the smudging of the surrounding, with a structure in which the first fixing roller 17*a* and the second fixing roller 17*b* are kept at the same electric potential as that of the recording paper sheet P grasped in the nip portion T by connecting the zener diodes ZD1 and ZD2 (refer to FIG. 13, because these are not shown in FIG. 14) to the first fixing roller 17*a* for the front side and to the second fixing roller 17*b* for the rear side respectively to keep the toner images on the front and rear sides being held on the surfaces of the recording paper sheet P.

By the above-mentioned structure, the leakage of charge from a transfer material is prevented to make the transfer of the rear side toner images be performed satisfactorily, while the disturbance of the toner images on the front and rear sides by the fixing members and the repulsion of the toner particles on the front and rear sides are prevented, and satisfactory two-sided images can be formed.

Moreover, toner images are directly formed on the image carrying member in each of the above-described examples of the image forming apparatus, but it may be appropriate to provide an image forming member separately from the image carrying member to make the toner images which have been formed on the image forming member be carried by the image carrying member. Further, in the above-described examples of the image forming apparatus, explanation has been given by using a color image forming apparatus; however, this invention should not be limited to this, and can be applied to a monochromatic image forming apparatus employing a process similar to those explained in FIG. 5 to FIG. 14.

Furthermore, it is a matter of course that, in the image forming apparatus of this invention, in addition to the two-sided image forming as has been explained in each of the above-described image forming apparatus in which images are formed on both sides of a transfer material, single-sided image forming in which an image is formed only on one side, that is, on the front side or on the rear side of a transfer material can be performed.

According to this invention, the leakage of electric charge from a transfer material is prevented and transfer of toner images on the rear side of the transfer material is performed satisfactorily, while the disturbance of toner images on the front and rear sides by the fixing means is prevented and satisfactory two-sided images can be formed.

What is claimed is:

1. A two-sided image forming apparatus comprising:

(a) an image carrying member;

(b) a toner image forming means for forming a toner image on the image carrying member;

(c) a belt-shaped intermediate transfer body for conveying a transfer material, having a volume resistivity R (Ω·cm) wherein the following expression is satisfied, $$10^9 \leqq R < 10^{12};$$

(d) a primary transferring means for transferring the toner image on the image carrying member onto the intermediate transfer body or a front face of the transfer material; and (e) a secondary transferring means for transferring the toner image on the intermediate transfer body onto a rear face of the transfer material, wherein the following expressions are satisfied, $$0.2 \leqq I(1B)/V \leqq 0.7$$

and $$0.6 \times I(1B) \leqq I(2) \leqq 1.4 \times I(1B)$$

where I(1B) (μA) represents an absolute value of a primary transfer current when the toner image on the image carrying member is transferred to the front face of the transfer material by the primary transferring means, I(2) (μA) represents an absolute value of a secondary transfer current when the toner image on the intermediate transfer body is transferred to the rear face of the transfer material by the secondary transferring means, and V (mm/sec) represents a moving velocity of the intermediate transfer body.

2. The two-sided image forming apparatus of claim 1, wherein the following expression is satisfied, $$0.4 \times I(1B) \leqq I(1A) \leqq 0.8 \times I(1B)$$

where I(1A) (μA) represents an absolute value of a primary transfer current when the toner image on the image carrying member is transferred to the intermediate transfer body by the primary transferring means.

3. The two-sided image forming apparatus of claim 1, wherein the absolute value of the primary transfer current I(1B) and the absolute value of the secondary transfer current I(2) further satisfy the following expression, $$0.8 \times I(1B) \leqq I(2) \leqq 1.2 \times I(1B).$$

4. The two-sided image forming apparatus of claim 1 further comprising a separating means disposed downstream of and apart from the secondary transferring means in a conveyance direction of the intermediate transfer body, for discharging an electric charge on the transfer material to thereby separate the transfer material from the intermediate transfer body.

5. The two-sided image forming apparatus of claim 1 further comprising a fixing means for interposing the transfer material to convey and for fixing the toner image transferred on both faces of the transfer material, the fixing means comprising a pair of rotatable fixing members, wherein an electric voltage of the same polarity as the transfer material on the both faces of which the toner images are transferred is applied to the fixing member to be in contact with the front face of the transfer material.

6. A two-sided image forming apparatus comprising:

(a) an image carrying member;

(b) a toner image forming means for forming a toner image on the image carrying member;

(c) a belt-shaped intermediate transfer body for conveying a transfer material, having a volume resistivity R (Ω·cm) wherein the following expression is satisfied, $$10^9 \leqq R < 10^{12};$$

(d) a primary transferring means for transferring the toner image on the image carrying member onto the intermediate transfer body or a front face of the transfer material; and (e) a secondary transferring means for transferring the toner image on the intermediate transfer body onto a rear face of the transfer material, wherein the following expression is satisfied, $$0.12 \leqq I(2)/V \leqq 0.98$$

where I(2) (μA) represents an absolute value of a secondary transfer current when the toner image on the intermediate transfer body is transferred to the rear face of the transfer material by the secondary transferring means, and V (mm/sec) represents a moving velocity of the intermediate transfer body.

7. The two-sided image forming apparatus of claim 6, wherein the following expression is satisfied, $$0.4 \times I(1B) \leqq I(1A) \leqq 0.8 \times I(1B)$$

where I(1A) (μA) represents an absolute value of a primary transfer current when the toner image on the image carrying member is transferred to the intermediate transfer body by the primary transferring means and I(1B) (μA) represents an absolute value of a primary transfer current when the toner image on the image carrying member is transferred to the front face of the transfer material by the primary transferring means.

8. The two-sided image forming apparatus of claim 6, wherein the absolute value of the primary transfer current I(1B) and the absolute value of the secondary transfer current I(2) further satisfy the following expression, $$0.6 \times I(1B) \leqq I(2) \leqq 1.4 \times I(1B).$$

9. The two-sided image forming apparatus of claim 6, wherein the absolute value of the secondary transfer current I(2) and the moving velocity V of the intermediate transfer body further satisfy the following expression, $$0.16 \leqq I(2)/V \leqq 0.84.$$

10. The two-sided image forming apparatus of claim 6 further comprising a separating means disposed downstream of and apart from the secondary transferring means in a conveyance direction of the intermediate transfer body, for discharging an electric charge on the transfer material to thereby separate the transfer material from the intermediate transfer body.

11. The two-sided image forming apparatus of claim 6 further comprising a fixing means for interposing the transfer material to convey and for fixing the toner image transferred on both faces of the transfer material, the fixing means comprising a pair of rotatable fixing members, wherein an electric voltage of the same polarity as the transfer material on the both faces of which the toner images are transferred is applied to the fixing member to be in contact with the front face of the transfer material.

12. A two-sided image forming apparatus comprising:

(a) a first image carrying member;

(b) a first image forming means for forming a toner image on the first image carrying means;

(c) a second image carrying member;

(d) a second image forming means for forming a toner image on the second image carrying means;

(e) a belt-shaped intermediate transfer body for conveying a transfer material, having a volume resistivity R (Ω·cm) wherein the following expression is satisfied, $$10^9 \leqq R < 10^{12};$$

(f) a first primary transferring means for transferring the toner image on the first image carrying member onto the intermediate transfer body;

(g) a second primary transferring means for transferring the toner image on the second image carrying member onto a front face of the transfer material; and (h) a secondary transferring means for the toner image on the intermediate transfer body onto a rear face of the transfer material, wherein the following expressions are satisfied, $$0.2 \leqq I_2(1B)/V \leqq 0.7$$

and $$0.6 \times I_2(1B) \leqq I(2) \leqq 1.4 \times I_2(1B)$$

where $I_2(1B)$ ($\mu$A) represents an absolute value of a second primary transfer current when the toner image on the second image carrying member is transferred to the front face of the transfer material by the second primary transferring means, I(2) ($\mu$A) represents an absolute value of a secondary transfer current when the toner image on the intermediate transfer body is transferred to the rear face of the transfer material by the secondary transferring means, and V (mm/sec) represents a moving velocity of the intermediate transfer body.

13. The two-sided image forming apparatus of claim 12, wherein the following expression is satisfied, $$0.4 \times I_2(1B) \leqq I_1(1A) \leqq 0.8 \times I_2(1B)$$

where $I_1(1A)$ ($\mu$A) represents an absolute value of a first primary transfer current when the toner image on the first image carrying member is transferred to the intermediate transfer body by the first primary transferring means.

14. The two-sided image forming apparatus of claim 12, wherein the absolute value of a second primary transfer current $I_2(1B)$ and the absolute value of the secondary transfer current I(2) further satisfy the following expression, $$0.8 \times I_2(1B) \leqq I(2) \leqq 1.2 \times I_2(1B).$$

15. The two-sided image forming apparatus of claim 12 further comprising a separating means disposed downstream of and apart from the secondary transferring means in a conveyance direction of the intermediate transfer body, for discharging an electric charge on the transfer material to thereby separate the transfer material from the intermediate transfer body.

16. The two-sided image forming apparatus of claim 12 further comprising a fixing means for interposing the transfer material to convey and for fixing the toner image transferred on both faces of the transfer material, the fixing means comprising a pair of rotatable fixing members, wherein an electric voltage of the same polarity as the transfer material on the both faces of which the toner images are transferred is applied to the fixing member to be in contact with the front face of the transfer material.

17. A two-sided image forming apparatus comprising:

(a) a first image carrying member;

(b) a first toner image forming means for forming a toner image on the first image carrying member;

(c) a second image carrying member;

(d) a second toner image forming means for forming a toner image on the second image carrying means;

(e) a belt-shaped intermediate transfer body for conveying a transfer material, having a volume resistivity R ($\Omega$·cm) wherein the following expression is satisfied, $$10^9 \leqq R < 10^{12};$$

(f) a first primary transferring means for transferring the toner image on the first image carrying member onto the intermediate transfer body;

(g) a second primary transferring means for transferring the toner image on the second image carrying member onto a front face of the transfer material; and (h) a secondary transferring means for transferring the toner image on the intermediate transfer body onto a rear face of the transfer material, wherein the following expression is satisfied, $$0.12 \leqq I(2)/V \leqq 0.98$$

where I(2) ($\mu$A) represents an absolute value of a secondary transfer current when the toner image on the intermediate transfer body is transferred to the rear face of the transfer material by the secondary transferring means, and V (mm/sec) represents a moving velocity of the intermediate transfer body.

18. The two-sided image forming apparatus of claim 17, wherein the following expression is satisfied, $$0.4 \times I_2(1B) \leqq I_1(1A) \leqq 0.8 \times I_2(1B)$$

where $I_1(1A)$ ($\mu$A) represents an absolute value of a first primary transfer current when the toner image on the first image carrying member is transferred to the intermediate transfer body by the first primary transferring means and $I_2(1B)$ ($\mu$A) represents an absolute value of a second primary transfer current when the toner image on the second image carrying member is transferred to the front face of the transfer material by the second primary transferring means.

19. The two-sided image forming apparatus of claim 17, wherein the absolute value of the second primary transfer current $I_2(1B)$ and the absolute value of a secondary transfer current I(2) further satisfy the following expression, $$0.6 \times I_2(1B) \leqq I(2) \leqq 1.4 \times I_2(1B).$$

20. The two-sided image forming apparatus of claim 17, wherein the absolute value of the secondary transfer current I(2) and the moving velocity V of the intermediate transfer body further satisfy the following expression, $$0.16 \leqq I(2)/V \leqq 0.84.$$

21. The two-sided image forming apparatus of claim 17 further comprising a separating means disposed downstream of and apart from the secondary transferring means in a conveyance direction of the intermediate transfer body, for discharging an electric charge on the transfer material to thereby separate the transfer material from the intermediate transfer body.

22. The two-sided image forming apparatus of claim 17 further comprising a fixing means for interposing the transfer material to convey and for fixing the toner image transferred on both faces of the transfer material, the fixing means comprising a pair of rotatable fixing members, wherein an electric voltage of the same polarity as the transfer material on the both faces of which the toner images are transferred is applied to the fixing member to be in contact with the front face of the transfer material.

23. A two-sided image forming apparatus comprising:

(a) an image carrying member;

(b) a toner image forming means for forming a toner image on the image carrying member;

(c) a belt-shaped intermediate transfer body for conveying a transfer material;

(d) a primary transferring means for transferring the toner image on the image carrying member onto the intermediate transfer body or a front face of the transfer material;

(e) a secondary transferring means for transferring the toner image on the intermediate transfer body onto a rear face of the transfer material; and (f) a fixing means for interposing the transfer material to convey and for fixing the toner image transferred on both faces of the transfer material, the fixing means comprising a pair of rotatable fixing members, wherein an electric voltage of the same polarity as the transfer material on the both faces of which the toner images are transferred is applied to the fixing member to be in contact with the front face of the transfer material.

24. The two-sided image forming apparatus of claim 23, wherein a high-resistance layer is provided on each of the fixing members which are in contact with the front and rear faces of the transfer material respectively, and volume resistivity of the high-resistance layer provided on each of the fixing members is higher than that of the intermediate transfer body.

25. The two-sided image forming apparatus of claim 23, wherein a volume resistivity of the high-resistance layer provided on each of the fixing members is higher than that of the transfer material.

26. The two-sided image forming apparatus of claim 23, wherein an absolute value of the electric voltage of 500 to 1500 is applied to the fixing member to be in contact with the front face of the transfer material.

27. The two-sided image forming apparatus of claim 23, wherein an absolute value of the electric voltage of 100 to 900 is applied to the fixing member to be in contact with the rear face of the transfer material.

28. The two-sided image forming apparatus of claim 23, wherein an absolute value of a difference in the voltage applied between the fixing member to be in contact with the front face and the fixing member to be in contact with the rear face of the transfer material, is 200 to 600 volts.

* * * * *